US010711579B2

(12) United States Patent
Sessa et al.

(10) Patent No.: US 10,711,579 B2
(45) Date of Patent: Jul. 14, 2020

(54) EROSION RESISTANT SHUNT TUBE ASSEMBLY FOR WELLSCREEN

(71) Applicant: Weatherford Technology Holdings, LLC, Houston, TX (US)

(72) Inventors: Michael J. Sessa, Houston, TX (US); Stephen McNamee, Rhode (IE); John S. Sladic, Katy, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/954,129

(22) Filed: Apr. 16, 2018

(65) Prior Publication Data

US 2019/0145232 A1 May 16, 2019

Related U.S. Application Data

(63) Continuation-in-part of application No. 15/814,522, filed on Nov. 16, 2017.

(51) Int. Cl.
*E21B 43/04* (2006.01)
*E21B 43/08* (2006.01)

(52) U.S. Cl.
CPC ..... *E21B 43/045* (2013.01); *E21B 43/04* (2013.01); *E21B 43/08* (2013.01)

(58) Field of Classification Search
CPC ..... E21B 43/045; E21B 43/08
See application file for complete search history.

(56) References Cited

U.S. PATENT DOCUMENTS

| | | | | |
|---|---|---|---|---|
| 5,842,516 | A * | 12/1998 | Jones | E21B 41/0078 166/56 |
| 5,868,200 | A | 2/1999 | Bryant et al. | |
| 7,147,054 | B2 | 12/2006 | Wang et al. | |
| 7,207,383 | B2 | 4/2007 | Hurst et al. | |
| 7,363,974 | B2 | 4/2008 | Wang et al. | |
| 8,783,348 | B2 | 7/2014 | Edwards et al. | |
| 9,074,458 | B2 | 7/2015 | Cunningham et al. | |
| 9,309,751 | B2 | 4/2016 | Hall | |
| 9,593,559 | B2 | 3/2017 | Yeh et al. | |
| 2004/0140089 | A1 | 7/2004 | Gunneroed | |
| 2005/0028977 | A1 | 2/2005 | Ward | |
| 2007/0131421 | A1 | 6/2007 | Hurst et al. | |
| 2013/0112399 | A1* | 5/2013 | Royer | E21B 41/0078 166/222 |

(Continued)

OTHER PUBLICATIONS

Schlumberger, "Alternate Path Technology," Brochure, dated May 2001, 8-pgs.

(Continued)

*Primary Examiner* — Giovanna C Wright
*Assistant Examiner* — Brandon M Duck
(74) *Attorney, Agent, or Firm* — Blank Rome, LLP

(57) ABSTRACT

A wellscreen has a gravel pack assembly installed that can communicate slurry from a transport tube to a pack tube. A bypass has erosion resistant surfaces exposed to flow of the conveyed slurry and diverts portion of the conveyed slurry from the fluid bore of the transport tube to a tube opening, from which the pack tube extends. The bypass can be incorporated into the top ring for supporting the filter on the basepipes. A sheath of erosion resistance can be formed on or installed in a channel of the end ring to be covered by a cover.

26 Claims, 17 Drawing Sheets

(56) References Cited

U.S. PATENT DOCUMENTS

| | | | | |
|---|---|---|---|---|
| 2013/0327542 | A1 | 12/2013 | Least et al. | |
| 2014/0014314 | A1 | 1/2014 | Cunningham et al. | |
| 2014/0238657 | A1 | 8/2014 | Sladic et al. | |
| 2014/0262208 | A1 | 9/2014 | Cunningham et al. | |
| 2014/0262332 | A1 | 9/2014 | McNamee et al. | |
| 2015/0129194 | A1 | 5/2015 | Veit | |
| 2015/0198016 | A1 | 7/2015 | Langlais | |
| 2015/0211341 | A1* | 7/2015 | Least | E21B 43/08 166/227 |
| 2016/0265318 | A1 | 9/2016 | Greci et al. | |
| 2017/0022789 | A1 | 1/2017 | Hodge et al. | |

OTHER PUBLICATIONS

Schlumberger, "OptiPac," Brochure, dated 2013, 8-pgs.
Halliburton, "PetroGuard® Openhole Shunt System," Brochure, dated Dec. 2016, 2-pgs.
Int'l Search Report and Written Opinion received in copending PCT Application No. PCT/US2018/057931 dated Jan. 29, 2019, 12 pages.

* cited by examiner

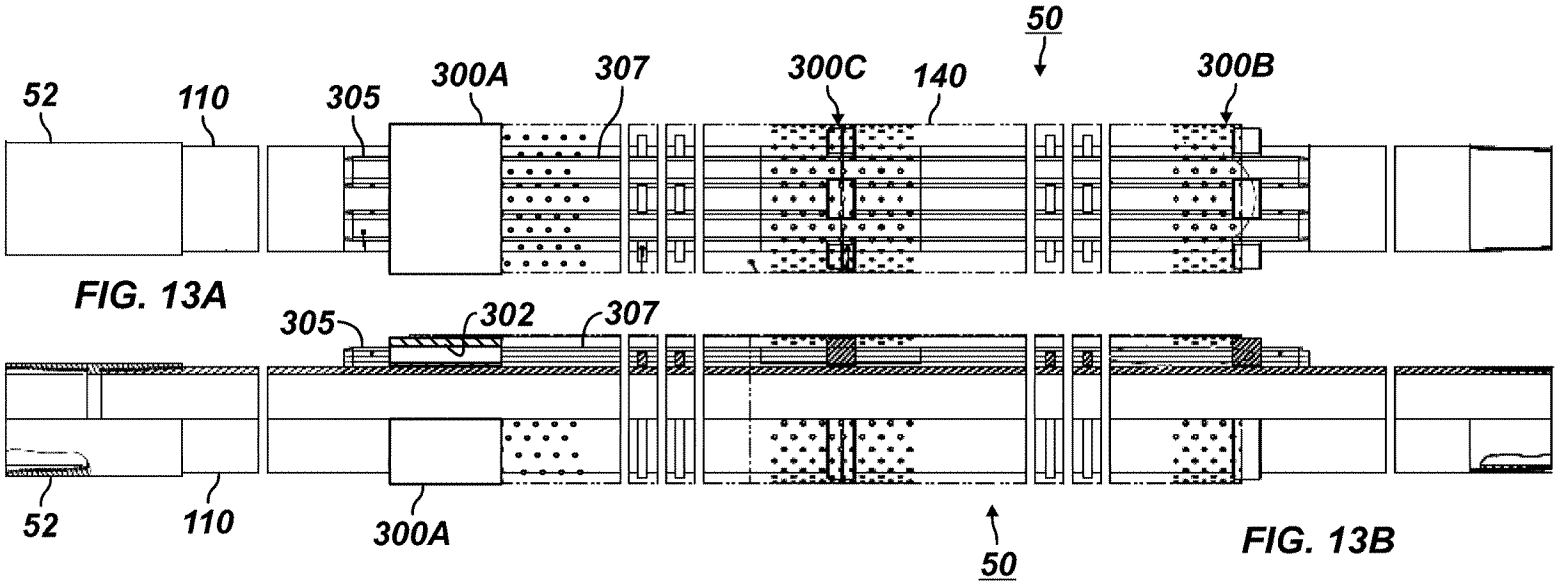
FIG. 13A
FIG. 13B
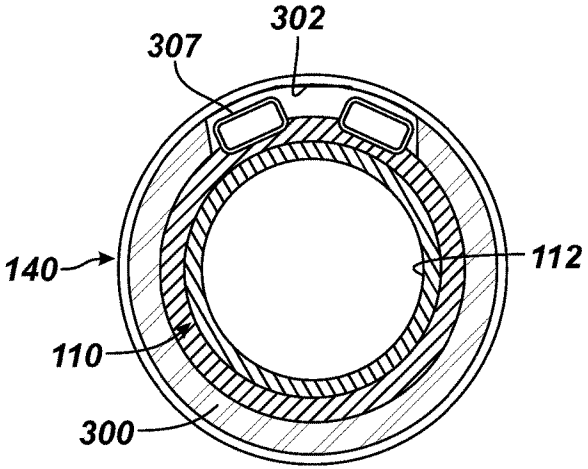
FIG. 13C

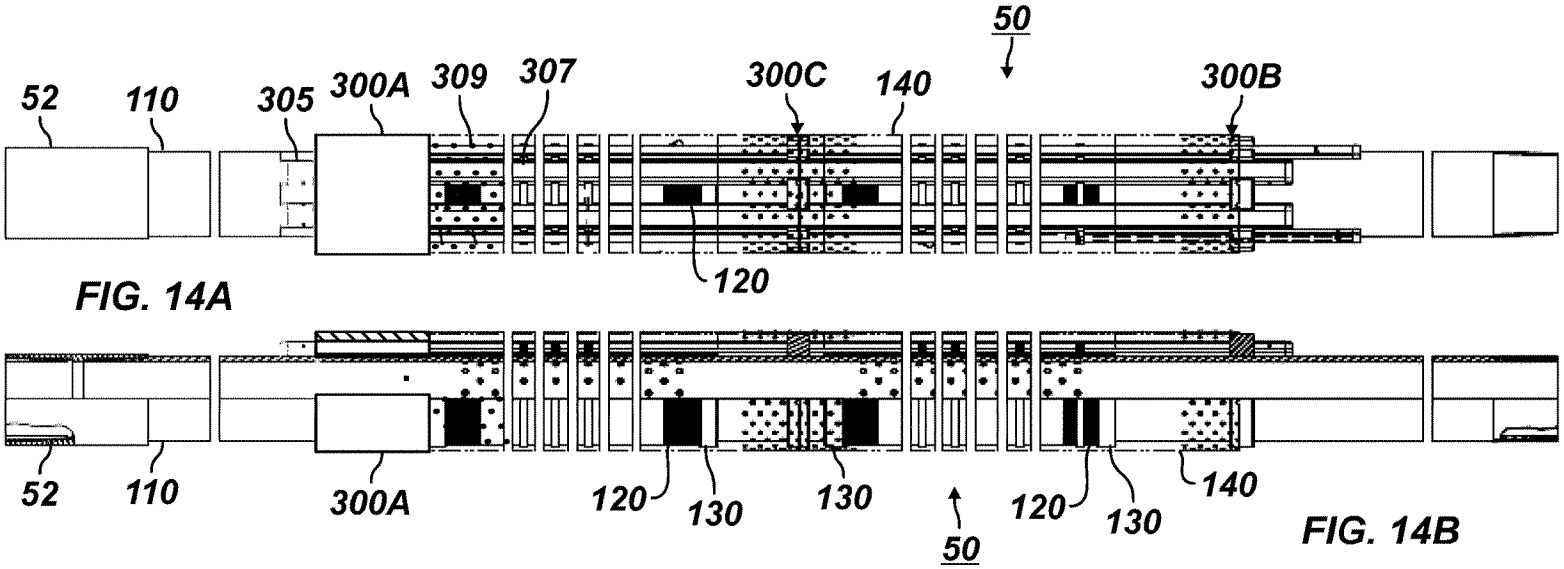
FIG. 14A
FIG. 14B
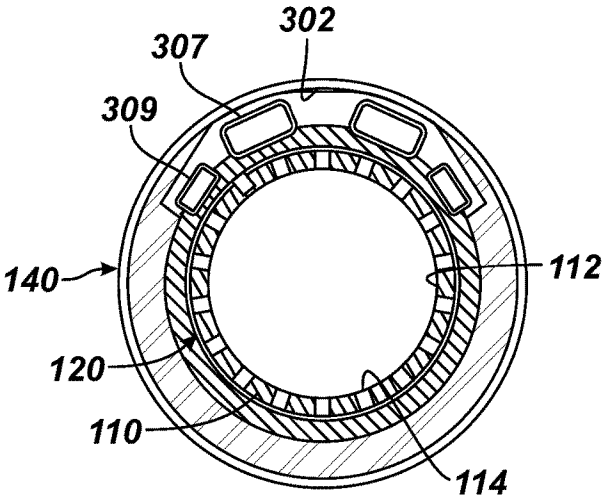
FIG. 14C

EROSION RESISTANT SHUNT TUBE ASSEMBLY FOR WELLSCREEN

BACKGROUND OF THE DISCLOSURE

This is a continuation-in-part of U.S. application Ser. No. 15/814,522, entitled "Erosion Resistant Shunt Tube Assembly for Wellscreen" and filed 16 Nov. 2017, which is incorporated herein by reference in its entirety.

BACKGROUND OF THE DISCLOSURE

A wellscreen may be used on a production string in a hydrocarbon well and especially in a horizontal section of the wellbore. Typically, the wellscreen has a perforated basepipe surrounded by a screen that blocks the flow of particulates into the production string. Even though the screen may filter out particulates, some contaminants and other unwanted materials can still enter the production string.

To reduce the inflow of unwanted contaminants, operators can perform gravel packing around the wellscreen. In this procedure, gravel (e.g., sand) is placed in the annulus between wellscreen and the wellbore by pumping a slurry of carrier fluid and gravel down a workstring and redirecting the slurry to the annulus with a crossover tool. As the gravel fills the annulus, it becomes tightly packed and acts as an additional filtering layer around the wellscreen to prevent the wellbore from collapsing and to prevent contaminants from entering the production string.

Ideally, the gravel uniformly packs around the entire length of the wellscreen, completely filling the annulus. However, during gravel packing, the slurry may become more viscous as carrier fluid is lost into the surrounding formation and/or into the wellscreen. Sand bridges can then form where the fluid loss occurs, and the sand bridges can interrupt the flow of the slurry and prevent the annulus from completely filling with gravel.

As shown in FIG. 1, for example, a wellscreen 30 is positioned in a wellbore 14 adjacent a hydrocarbon bearing formation. Gravel 13 pumped in a slurry down the production tubing 11 passes through a crossover tool 33 and fills an annulus 16 around the wellscreen 30. As the slurry flows, the formation may have an area of highly permeable material 15, which draws liquid from the slurry. In addition, fluid can pass through the wellscreen 30 into the interior of the tubular and then back up to the surface. As the slurry loses fluid at the permeable area 15 and/or the wellscreen 30, the remaining gravel may form a sand bridge 20 that can prevent further filling of the annulus 16 with gravel.

To overcome sand-bridging problems, shunt tube systems have been developed to create an alternative route for gravel around areas where sand bridges may form. Shunt tube systems are used frequently in gravel packing horizontal, open hole wells. The system uses transport tubes and pack tubes placed along a wellscreen to divert gravel pack slurry past premature bridging or obstructions in the wellbore. The tubes allow the gravel pack slurry to continue to gravel pack the well further downhole. Current external shunt tube systems used for open hole gravel packing operation may have two transport tubes and two pack tubes that provide individual flow paths for the gravel pack slurry. These tubes are located external to the sand screen.

For example, a gravel pack apparatus 100 shown in FIGS. 2A-2C positions within a wellbore 14 and has shunts in the form of transport tubes 140 and pack tubes 150 for creating the alternate route for slurry during a gravel pack operation.

The pack tubes 150 have nozzles 152 for exiting of the slurry. As before, the apparatus 100 can connect at its upper end to a crossover tool (33; FIG. 1), which is in turn suspended from the surface on tubing or workstring (not shown).

The apparatus 100 includes a wellscreen assembly 105 having a basepipe 110 with perforations 114 as described previously. Disposed around the basepipe 110 is a screen 120 that allows fluid to flow therethrough while blocking particulates.

The transport and pack tubes 140, 150 are disposed on the outside of the basepipe 110 and can be secured by end rings (not shown). As shown in the end view of FIG. 2A, centralizers 132 can be disposed on the outside of the basepipe 110, and a tubular shroud 135 having perforations 137 can protect the transport and pack tubes 140, 150 and the wellscreen 105 from damage during insertion of the apparatus 100 into the wellbore 14.

At an upper end (not shown) of the apparatus 100, each transport tube 140 can be open to the annulus 16 or may be in fluid communication with another transport tube of another wellscreen joint. Internally, each transport tube 140 has a flow bore for passage of slurry. The slurry can be diverted to the pack tubes 150, which have the nozzles 152 disposed at ports in the sidewall of each pack tube 150 to allow the slurry to exit the pack tube 150. As shown in FIG. 2C, the nozzles 152 can be placed along the pack tube 150 so each nozzle 152 can communicate slurry from the ports and into the surrounding annulus 16. As shown, the nozzles 152 are typically oriented to face toward the wellbore's downhole end (i.e., distal from the surface) to facilitate streamlined flow of the slurry therethrough.

In a gravel pack operation, the apparatus 100 is lowered into the wellbore 14 on a workstring and is positioned adjacent a formation. A packer (18; FIG. 1) is set, and gravel slurry is then pumped down the workstring and out the outlet ports in the crossover tool (33; FIG. 1) to fill the annulus 16 between the wellscreen 105 and the wellbore 14. Because the transport tubes 140 are open at their upper ends, the slurry can flow into both the transport tubes 140 and the annulus 16, but the slurry typically stays in the annulus 16 as the path of least resistance at least until a bridge is formed. As the slurry loses liquid to a high permeability portion 15 of the formation and the wellscreen 105, the gravel carried by the slurry is deposited and collects in the annulus 16 to form the gravel pack.

Should a sand bridge 20 form and prevent further filling below the bridge 20, the gravel slurry continues flowing through the transport tubes 140, bypassing the sand bridge 20 and exiting the various nozzles 152 on the pack tubes 150 to finish filling annulus 16. The flow of slurry through one of the transport tubes 140 is represented by arrow 102.

As can be seen from the above example, the top end ring for an open hole external shunt tube system can secure the transport tubes 140 and pack tubes 150 mechanically to the basepipe 110. In some arrangements, the top end ring can provide a conduit for the fluid to exit the transport tube 140 and to enter the pack tube 150. Because the gravel pack slurry is pumped at elevated pressures through the shunt tube assembly and is a sand-laden, abrasive, and highly erosive, the flow of slurry can erode and damage components, such as such top end rings.

As is typical, the external shunt tube system as depicted in FIG. 2A is eccentric so that the centerline of the shunt tube system is offset from the centerline of the basepipe and the screen. Each of the transport tubes is independent of the other transport tube. If one of the transport tubes plugs, then there is no recovery mode, and operable use of half the system is lost. This increases the possibility of a failed gravel pack operation.

Historically, the problem has been addressed by using an internal shunt tube design, such as disclosed, for example, in US 2005/0028977. The internal shunt tube design places transport tubes and pack tubes internal to the sand screen. The internal shunted system is a concentric system in which the basepipe, the screen, and the shunt system all share the same centerline. A sealed housing is provided over the connection from the pin end of one screen to the box end of the next screen. The concentric annulus formed by this sealed housing and the basepipe and coupling allows for commingling of the gravel pack slurry at the connection of each joint.

Although such a concentric shunt system may be useful, it may require a complicated set of components and assembly steps when running wellscreen in hole. Operators are continually striving to simplify assembly steps in running wellscreens and shunt systems in hole, while still meeting the demands for gravel packing horizontal, open hole wells of extended length.

The subject matter of the present disclosure is directed to overcoming, or at least reducing the effects of, one or more of the problems set forth above.

SUMMARY OF THE DISCLOSURE

A gravel pack assembly according to the present disclosure delivers slurry along tubing of a wellscreen. The assembly comprises an end ring, a transport tube, a bypass, and a pack tube. The end ring positions about the tubing, and the transport tube extends from the end ring along the tubing of the wellscreen and defines a fluid bore therethrough for conveying the slurry. The bypass has erosion-resistant surfaces exposed to flow of the conveyed slurry and has an outlet. The bypass diverts a portion of the conveyed slurry from the fluid bore of the transport tube to the outlet. The pack tube is in fluid communication from the outlet and extends along the tubing of the wellscreen. The pack tube has at least one outlet port, which can include a nozzle, for delivering slurry around the wellscreen.

In one arrangement, the bypass comprises a channel disposed in the end ring, the channel defines a first tube opening on a first side of the end ring and defining a second tube opening and the outlet on the second side of the end ring. The transport tube has a first end positioning in fluid communication with the second tube opening, and the pack tube has a second end positioning in fluid communication with the outlet. The bypass comprises an erosion resistant sheath positioned inside the channel and having the erosion-resistant surfaces exposed to the convey slurry.

The channel can be exposed externally on the end ring. Accordingly, the bypass can include a cover positioning against the end ring and enclosing the channel. The erosion resistant sheath of the bypass can include a coating being erosion-resistant and disposed in the channel, one or more inserts composed of erosion-resistant material and disposed in the channel, or one or more plates composed of erosion-resistant material and disposed in the channel.

With respect to the one or more inserts, a block inset can fit into the channel to encompass both a slot and side pocket of the channel in the end ring. The block insert can provided a main passage for the transport tube and can provide a diverted passages for delivery of the slurry from the main passage to the pack tube. Alternatively, with respect to the one or more inserts, an angled insert can communicate a side port of the transport tube from a slot in which the transport tube passes, and a pocket insert can insert in the outlet of the end ring to fit in a side pocket of the channel and can communicate the angled insert to the pack tube connected to the outlet.

In another arrangement, the bypass includes a slot defined in the end ring. The transport tube is disposed in the slot and has a first side port. The bypass also includes a channel defined in the end ring and an erosion resistant sheath positioned inside the channel. The channel has a second side port in fluid communication with the first side port and has the outlet in communication with the pack tube. The erosion resistant sheath has the erosion-resistant surfaces exposed to the conveyed slurry. For example, the erosion resistant sheath can include an angled insert disposed in the second side port and communicating with the first side port; and a pocket insert disposed in the outlet and communicating the angled insert with the pack tube.

In yet another arrangement, the end ring defines a slot, and the transport tube positions in the slot. The bypass comprises a body positioned on the transport tube at a first side port of the transport tube. The body defines a channel having a second side port and the outlet. The second side port communicates with the first side port, and the pack tube positions in fluid communication with the outlet. The body can be composed of an erosion-resistant material. The transport tube can have more than one first side port, and more than one bodies of the bypass and pack tubes can be used on the same transport tube.

A wellscreen of the present disclosure can be used in a borehole annulus. The wellscreen can include a basepipe having a throughbore, a filter disposed on the basepipe and separating fluid communication between the throughbore and the borehole annulus, and first and second end rings supporting ends of the filter on the basepipe. A gravel pack assembly as disclosed above can be used on such a wellscreen.

In one particular embodiment, a gravel pack assembly can be used for delivering slurry along tubing of a wellscreen. The assembly comprises an end ring, a transport tube, a pack tube, and an erosion-resistant sheath. The end ring has first and second sides opposing one another and defines a channel therein. The channel has a first tube opening on the first side and has second and third tube openings on the second side. The transport tube has a first end positioning in fluid communication with the second tube opening on the second side of the end ring and positions along the tubing of the wellscreen. The pack tube has a second end positioning in fluid communication with the third tube opening on the second side of the end ring and positioning along the tubing of the wellscreen.

The erosion-resistant sheath has erosion-resistant surfaces disposed inside the channel and exposed to the conveyed slurry. The erosion-resistant surfaces communicates the first tube opening with the second and third tube openings.

The end ring can be comprised of segments positioning about the tubing, and at least one of the segments can define the channel.

The channel can be exposed externally on the end ring. In this instance, a cover positions against the end ring and enclosing the channel.

The erosion-resistant sheath can take a number of forms. For example, the sheath can include a coating of erosion resistant material disposed on an inside surface of the channel. The erosion-resistant sheath can include a hard surfacing of erosion resistance disposed on an inside surface of the channel. The erosion-resistant sheath can include a plurality of plates of erosion-resistant material affixed on an inside surface of the channel. The erosion-resistant sheath can include one or more inserts disposed in the channel, the one or more inserts defining a first fluid passage therethrough communicating the first tube opening with the second tube opening, the one or more inserts defining a second fluid passage therethrough communicating the first tube opening with the third tube opening.

The one or more inserts can be composed of an erosion resistant material. Alternatively, the one or more inserts can include a coating of erosion resistant material disposed on an inside surface of the first and second fluid passages.

In other variations, the first fluid passage can define a longitudinal axis from the first tube opening to the second tube opening. The second fluid passage can define an angled section communicating off the longitudinal axis of the first fluid passage and can define a longitudinal section communicating with the second tube opening. The assembly can further include one or more additional end rings, covers, transport tubes, pack tubes, and sheaths spaced along a length of the tubing of the wellscreen.

As disclosed herein, a gravel pack assembly for delivering slurry along tubing of a wellscreen comprises a ring, first tubes, and second tubes. The ring is disposed on the tubing of the wellscreen and has first and second ring sections. The first ring section is disposed at least partially on the second ring section, and the first and second ring sections disposed together define a chamber therein. The chamber has first tube openings on a first side of the first ring section and has second tube openings on a second side of the second ring section. The first tubes for conveying the slurry each has a first end positioning in fluid communication with the first tube opening on the first side of the first ring section and each positioning along the tubing of the wellscreen. The second tubes for conveying the slurry each has a second end positioning in fluid communication with the second tube opening on the second side of the second ring section and each positioning along the tubing of the wellscreen.

The ring can be disposed concentrically on the tubing. The chamber can have at least one third tube opening on the second side of the second ring portion. The assembly can further comprise at least one third tube having a third end positioning in fluid communication with the at least one third tube openings on the second side of the second ring section and positioning along the tubing of the wellscreen. For example, the at least one third tube can comprise a pack tube delivering the slurry outside the pack tube and adjacent the wellscreen.

The first and second end ring sections can each comprise segments positioning about the tubing. The second ring section can define a channel for the chamber exposed externally on the second ring section; and the first ring section can comprise a sleeve positioning over portion of the second ring section and enclosing the channel to form the chamber.

According to the present disclosure, the assembly further comprises an erosion-resistant sheath having erosion-resistant surfaces disposed inside the chamber and exposed to the conveyed slurry communicating between the first and second tube openings. For example, the erosion-resistant sheath comprises one of: a coating of erosion resistant material disposed on an inside surface of the chamber; a hard surfacing of erosion resistance disposed on the inside surface of the chamber; a plurality of plates of erosion-resistant material affixed on the inside surface of the chamber; an insert disposed in the chamber and composed of an erosion resistant material, the insert defining a fluid passage therethrough communicating the first tube openings with the second tube openings; and an insert disposed in the chamber, the insert defining a fluid passage therethrough communicating the first tube openings with the second tube openings, the insert comprising a coating of erosion resistant material disposed on an inside surface of the fluid passage.

According to one further embodiment, the assembly comprises at least one filter disposed on the tubing of the wellscreen, and the ring is disposed on the tubing adjacent a first end of the at least one filter. They can also comprise at least one shroud disposed on the tubing of the wellscreen about the at least one filter, and the ring can support a second end of the at least one shroud. In fact, first and second filters can be disposed on the tubing of the wellscreen with the ring used as an intermediate ring disposed on the tubing between ends of the first and second filters and supporting opposing ends of the first and second shrouds.

According to another embodiment, the assembly can comprises jumper tubes connected to the first tubes and extending beyond a joint of the tubing of the wellscreen, and the second tubes comprises transport tubes for communicating the slurry with another wellscreen.

According to yet another embodiment, wherein the first and second ring sections can each define a channel forming portion of the chamber. The ring can comprise a sleeve disposed at least partially on the first and second ring sections and enclosing the channels to form the chamber therein.

According to the present disclosure, the assembly can be a wellscreen for use in a borehole annulus. In this case, the wellscreen can comprise: a basepipe having a throughbore; at least one filter disposed on the basepipe and separating fluid communication between the throughbore and the borehole annulus, the ring, the first transport tubes, and the second transport tubes as disclosed above.

According to the present disclosure, a gravel pack assembly for delivering slurry along tubing of a wellscreen comprises a ring, one or more first tubes, one or more section tubes, and an erosion-resistant sheath. The ring disposed on the tubing of the wellscreen has first and second sides opposing one another and defines a chamber therein. The chamber has one or more first tube openings on the first side and has one or more second tube openings on the second side. The one or more first tubes for conveying the slurry each has a first end positioning in fluid communication with one of the one or more first tube openings on the first side of the ring and each positions along the tubing of the wellscreen. The one or more second tubes for conveying the slurry each has a second end positioning in fluid communication with one of the one or more second tube openings on the second side of the ring and each positions along the tubing of the wellscreen.

The erosion-resistant sheath has erosion-resistant surfaces disposed inside the chamber and exposed to the conveyed slurry. The erosion-resistant surfaces communicates the one or more first tube openings with the one or more second tube openings. As before, the ring can comprise segments positioning about the tubing with at least one of the segments defining the chamber. The erosion-resistant sheath can comprise one of: a coating of erosion resistant material disposed on an inside surface of the chamber; a hard surfacing of erosion resistance disposed on the inside surface of the chamber; a plurality of plates of erosion-resistant material affixed on the inside surface of the chamber; one or more inserts disposed in the chamber, the one or more inserts defining at least one fluid passage therethrough communicating the one or more first tube openings with the one or more second tube openings, wherein the one or more inserts are composed of an erosion resistant material; and one or more inserts disposed in the chamber, the one or more inserts defining at least one fluid passage therethrough communicating the one or more first tube openings with the one or more second tube openings, wherein one or more inserts comprise a coating of erosion resistant material disposed on an inside surface of the at least one fluid passage. These and other variations as disclosed above can be used for this assembly.

The foregoing summary is not intended to summarize each potential embodiment or every aspect of the present disclosure.

BRIEF DESCRIPTION OF THE DRAWINGS

FIGS. 13A-13C illustrate a side view, a partial cross-sectional view, and an end sectional view of a wellscreen having rings for commingling the conveyed slurry of a gravel pack assembly according to the present disclosure.

FIGS. 14A-14C illustrate a side view, a partial cross-sectional view, and an end sectional view of a wellscreen having rings for commingling the conveyed slurry of a gravel pack assembly according to the present disclosure.

DETAILED DESCRIPTION OF THE DISCLOSURE

Figure 1:
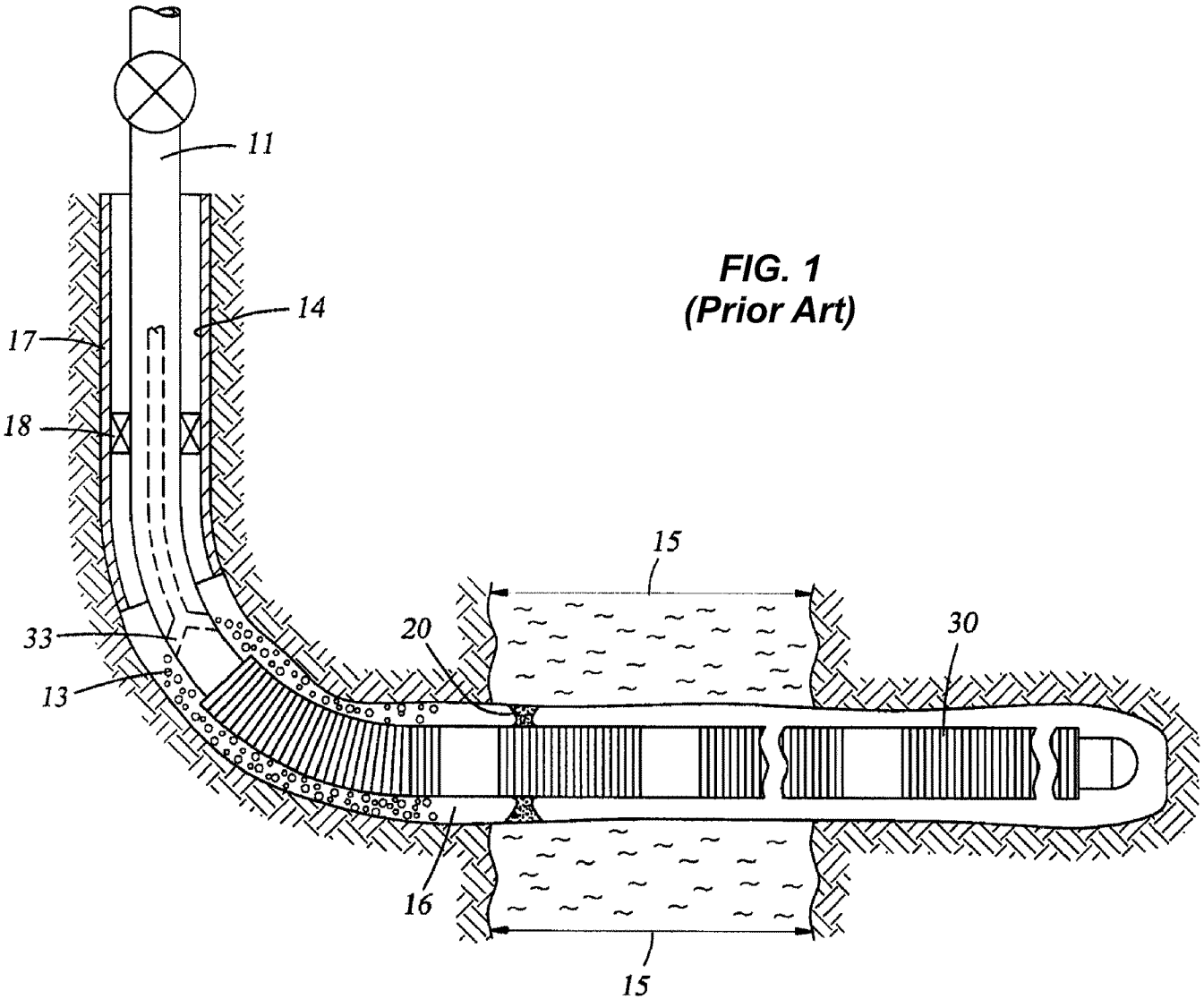
FIG. 1 (Prior Art)
FIG. 1 is a side view, partially in cross-section, of a horizontal wellbore with a wellscreen therein.
Figure 2B:
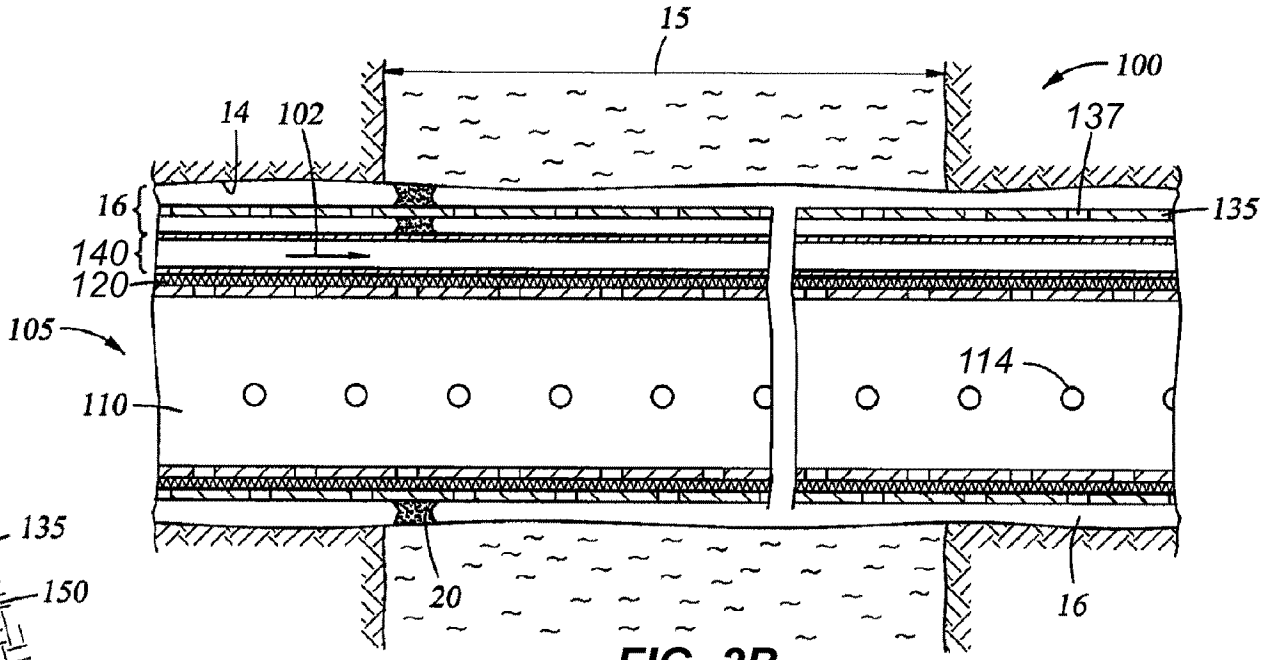
FIG. 2B (Prior Art)
FIG. 2B is a cross-sectional view of the gravel pack apparatus positioned within the wellbore adjacent a highly permeable area of a formation.
Figure 2C:
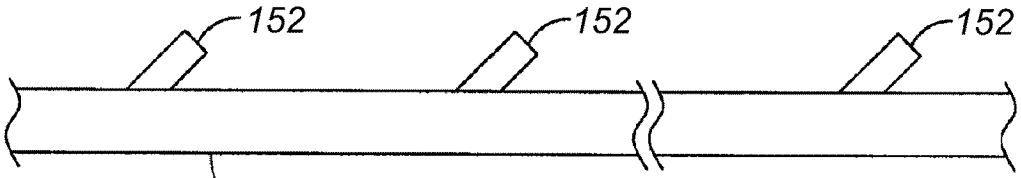
FIG. 2C (Prior Art)
FIG. 2C is a side view of a shunt tube showing placement of nozzles along the shunt tube.
Figure 2A:
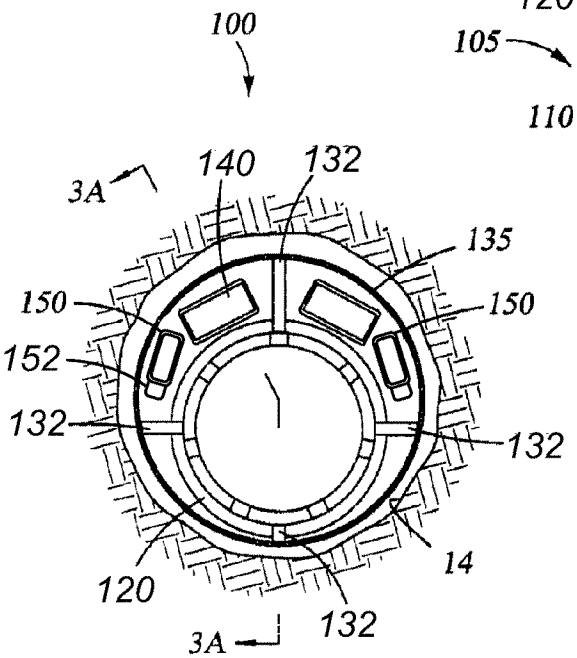
FIG. 2A (Prior Art)
FIG. 2A is an end view of a gravel pack apparatus positioned within a wellbore.
Figure 3:
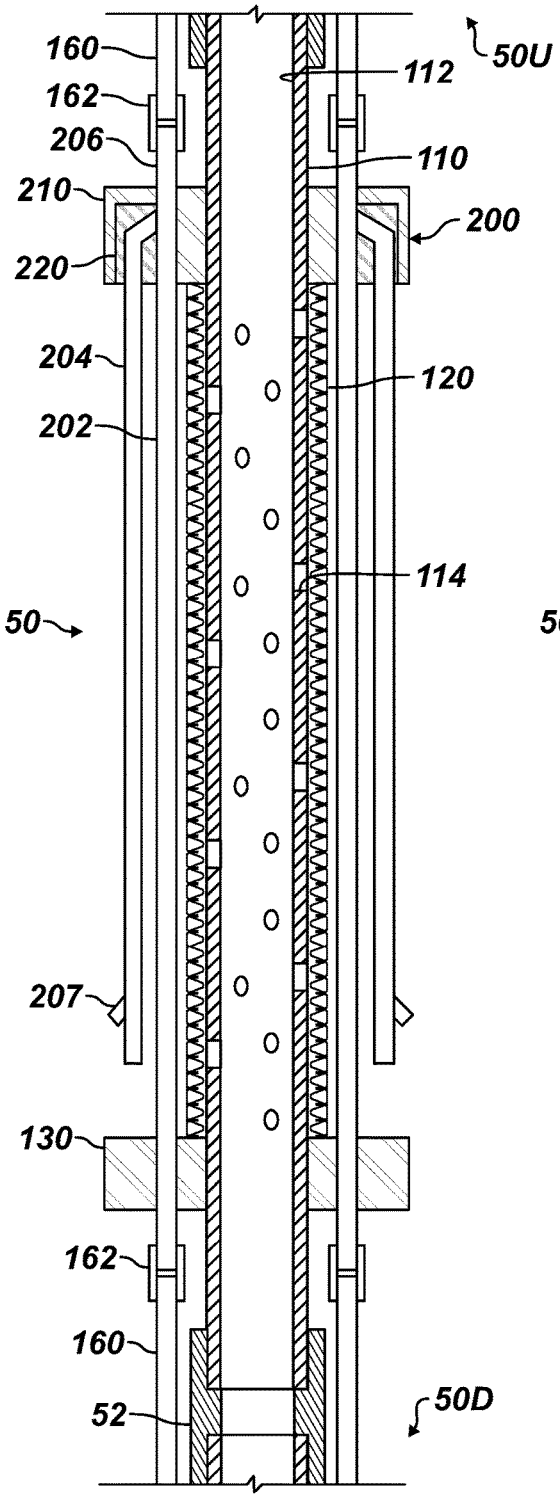
FIG. 3 illustrates a wellscreen having a gravel pack assembly according to one embodiment of the present disclosure.

Turning to FIG. 3, a wellscreen 50 includes tubing or basepipe 110 with perforations 114 in its throughbore 112. A filter or screen 120 is disposed about the basepipe 110 to screen fluid flow through the perforations 114 and into the throughbore 112. End rings 210 and 130 support the screen 120 on the basepipe 110.

A gravel pack assembly 200 delivers slurry along the basepipe 110 of the wellscreen 50 for gravel packing a wellbore annulus around the screen 120. The assembly 200 includes the top end ring 210, one or more transport tubes 202, one or more pack tubes 204, and one or more bypasses 220. Slurry from an uphole wellscreen 50U is delivered by jumper tubes 160 connected by connectors 162 to transport tube stubs 206 on the top ring 210. Although they may not be necessary, the connectors 162 may use features including lugs, fasteners, locks, snap collets, snap rings, and the like to connect the ends of the transport tube stubs 206 and the jumper tubes 160 together.

The bypasses 220 communicate the delivered slurry to the transport tubes 202. The bypasses 220 are at least partially erosion resistant and divert a portion of the conveyed slurry to the pack tubes 204 for gravel packing the wellbore annulus of the screen 120. In one arrangement, the bypasses 220 use a hard face or coating on an internal surface of the top end ring 210 in fluid contact with the slurry to isolate the slurry's flow from the top ring's base material. In an alternative, the bypasses 220 include an erosion resistant insert that effectively isolates the flow from the top ring's base material.

As shown, the transport tubes 202 extend from the top end ring 210 along the basepipe 110 and defines a fluid bore therethrough for conveying the slurry to jumper tubes 160 connected across a joint to a downhole wellscreen 50D. Like the transport tubes 202, the pack tubes 204 extend in fluid communication from the bypass 220 along the basepipe 110 of the wellscreen 120. To actually deliver the slurry for the gravel pack to the annulus, the pack tubes 204 have at least one outlet port or nozzle 207.

As is typically done, the wellscreen 50 is pre-assembled with the screen 120 positioned on the basepipe 110 and secured by the end rings 210, 130. Various features of the transport tubes 202, pack tubes 204, tube stubs 206, bypasses 220, and the like can also be pre-assembled on the wellscreen 50. During run in at the rig, the blank section of the basepipe 110 beyond the end rings 210, 130 of adjoining wellscreens (e.g., 50 & 50D) are used for handling, and the basepipe 110 of the wellscreen 50 is made up with a joint connector 52 to the downhole wellscreen 50D. The jumper tubes 160 and connectors 162 are then connected across the joint to connect the wellscreen's transport tubes 202 with those of the downhole wellscreen 50D. The tubing is then lowered, and the uphole wellscreen 50U is connected, and the assembly is repeated.

As will be appreciated, the wellscreens 50 can have any desired length. In general, the deployment length for shunt tube assemblies 200 along wellscreens 50 is a function of the fluid friction loss across the length of deployment. As current completion designs progress, the shunt tube assemblies 200 may need to have deployment lengths of at least 4,000 feet and preferably exceeding 5,000 feet.

The screen or filter 120 can include any structure commonly used by the industry in gravel pack operations, including, but not limited to a wire-wrapped screen, a mesh screen, a packed screen, slotted or perforated liner or pipe, etc. The transport tubes 202, pack tubes 204, jumper tubes 160, and stubs 206 are typically composed of a suitable metal, such as 316L grade stainless steel, as can the end rings 210, 130. Various types of connectors 162 can be used to connect the jumper tubes 160 to the transport tubes 202.

Figure 4A:
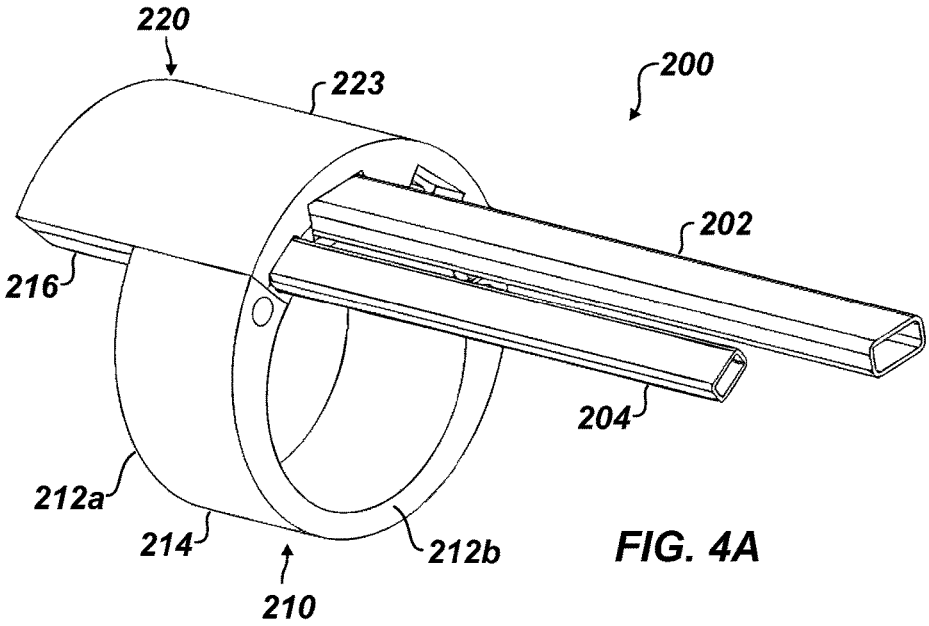
FIGS. 4A-4B illustrate a perspective view and an exploded view of one arrangement of the disclosed gravel pack assembly.
Figure 4B:
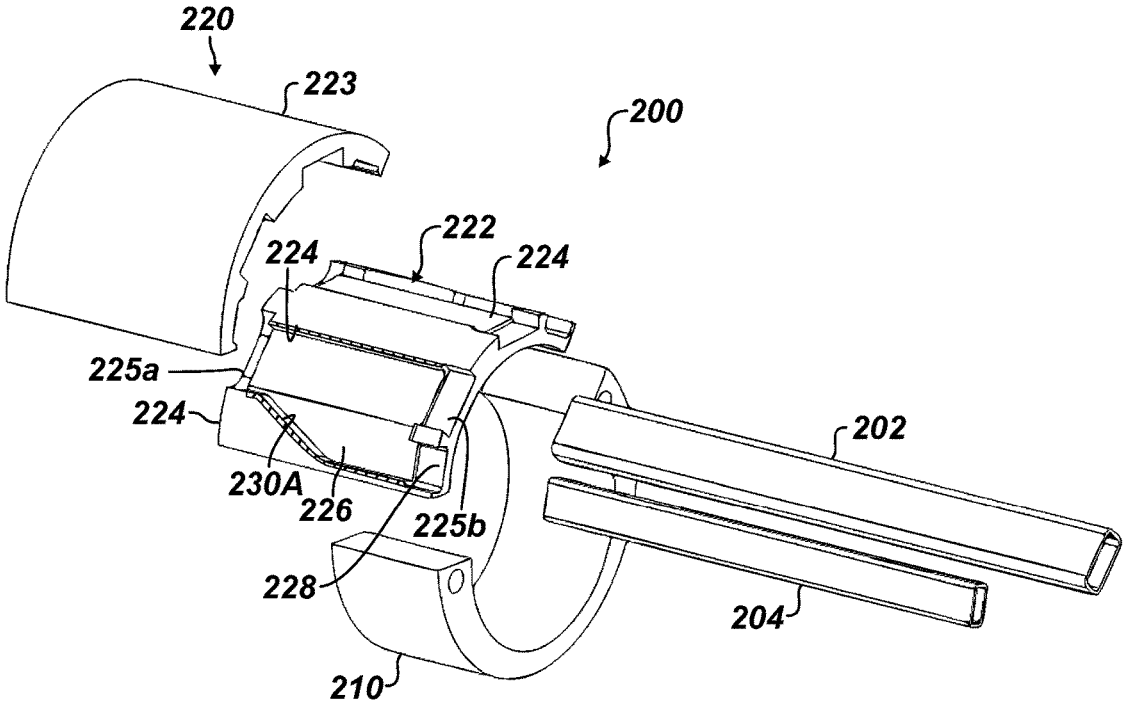

FIGS. 4A-4B illustrate a perspective view and an exploded view of one arrangement of the disclosed gravel pack assembly 200. The top end ring 210 is shown in isolation with truncated sections of the transport and pack tubes 202, 204 for illustrative purposes. The end ring 210 has first and second sides 212*a-b* opposing one another, and the bypass 220 defines a channel 222 (having a slot 224 with a side pocket 226) exposed externally on the end ring 210. The slot 224 defines a first tube opening 225*a* on the end ring's first side 212*a* (for connection to the tube stub 206 of FIG. 3) and defines a second tube opening 225*b* on the end ring's second side 212*b* (for connection to the transport tube 202). The side pocket 226 communicates off of the side of the slot 224 to a third tube openings 228 on the end ring's second side 212*b* (for connection to the pack tube 204). Accordingly, the transport tube 202 has a proximal end positioning in fluid communication with the second tube opening 225*b* on the end ring's second side 212*b*, while the pack tube 204 has a proximal end positioning in fluid communication with the third tube opening 228 on the end ring's second side 212*b*.

The bypass 220 includes a cover 223 positioning against the end ring 210 and enclosing the externally exposed slot 224 and side pocket 226. For assembly, the end ring 210 can include two or more segments 214, 216 positioning about the wellscreen's basepipe (110), and one of the segments 216 can define the slot 224 with the pocket 226. If additional transport and pack tubes 202, 204 are desired, the segment 216 can include an additional slot 224 with side pocket 226 for delivering slurry along additional tubes 202, 204. The cover 223 can enclose both slots 224 with pockets 226, or a separate cover can be used.

As best shown in FIG. 4B, the bypass 220 further includes a sheath 230A that is at least partially erosion resistant and is positioned inside the slot 224 and the pocket 226. The sheath 230A communicates the first tube opening 225*a* with the second and third tube openings 225*b* and 228. In this way, the sheath 230A forms a first fluid passage of the slot 224 defining a longitudinal axis from the first tube opening 225*a* to the second tube opening 225*b*. Additionally, the sheath 230A forms a second fluid passage of the pocket 226 defining an angled section communicating off the longitudinal axis of the first fluid passage and defining a longitudinal section communicating with the second tube opening 228. In this way, the bypass 220 having the sheath 230A in the slot 224 and side pocket 226 can convey slurry from the transport stub 206 at the opening 225*a* to the transport tube 202 at the opening 225*b* and can divert portion of the conveyed slurry to the pack tube 204 at the opening 228.

The sheath 230A of the bypass 220 includes an erosion resistant material disposed on, formed on, or coated on an inside surface of the slot 224 and the side pocket 226 (and comparably on the cover 223). For example, the slot 224 and the side pocket 226 can be formed in the ring segment 216 (along with a comparable relief in the cover 223 if necessary). The sheath 230A can be applied as a coating of the erosion-resistant material on the inside surface of the slot 224 and side pocket 226. The underside of the cover 223 may include a comparable relief to complete the slot 224 and the side pocket 226 and may likewise have a coating of the erosion-resistant material.

In another example, the sheath 230A can include hard-surface treatment of the inside surfaces. Alternatively, the sheath 230A can include ceramic, hard chrome, silicon carbide, or a similar erosion resistant material disposed on, coated on, electroplated on, etc. the inside surfaces. The material used for the sheath 230A can include hard banding or a WearSox® thermal spray metallic coating. (WEARSOX is a registered trademark of Wear Sox, L.P. of Texas). A coating or plating composed of any other suitable material, such as "hard chrome," can be applied to the surfaces for erosion resistance. Either way, the sheath 230A of the bypass 220 can mitigate direct erosion from the communicated slurry that would undermine the integrity of the top end ring 210, which is used for supporting the end of the screen (120) on the basepipe (110).

Figure 5:
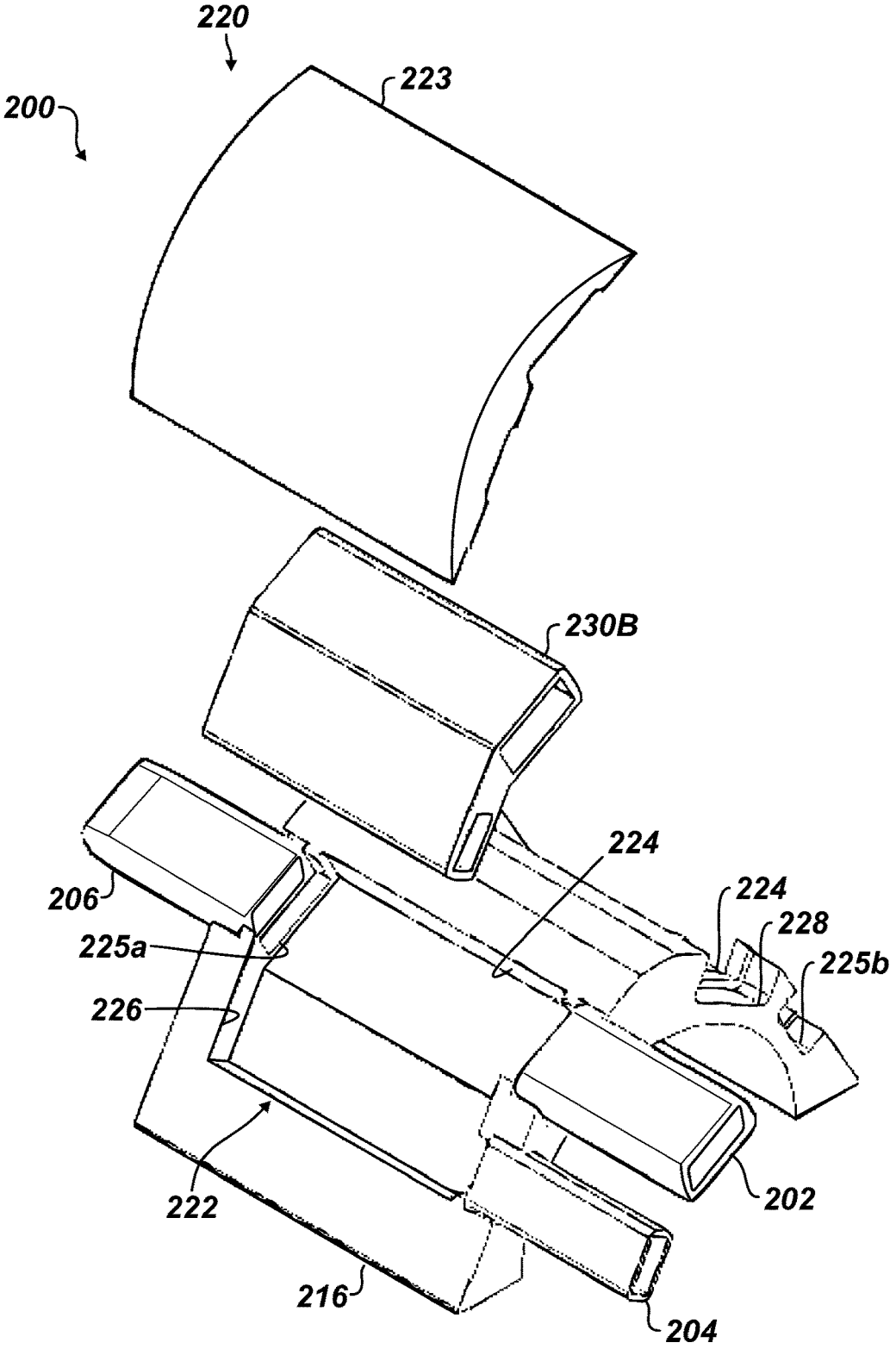
FIG. 5 illustrates an exploded view of another arrangement of the disclosed gravel pack assembly.

FIG. 5 illustrates an exploded view of another arrangement of the disclosed gravel pack assembly. One of the segments 216 of the assembly 220 is shown in isolation with truncated sections of the transport and pack tubes 202, 204 and the tube stub 206 for illustrative purposes. Again, the bypass 220 defines a channel 222 (a slot 224 with a side pocket 226) exposed externally on the end ring segment 216. The slot 224 defines a first tube opening 225*a* on one side for connection to the tube stub 206 and defines a second tube openings 225*b* on the other side for connection to the transport tube 202. The side pocket 226 communicates off of the side of the slot 224 to a third tube openings 228 on the end ring's second side for connection to the pack tube 204.

The bypass 220 also includes a cover 223 positioning against the end ring 210 and enclosing the externally exposed slot 224 and side pocket 226. As before, the segment 216 can define an additional slot 224 with side pocket 226 for delivering slurry along additional tubes (not shown), and a separate cover (not shown) can be used to enclose the other slot 224 with pocket 226.

Figure 6:
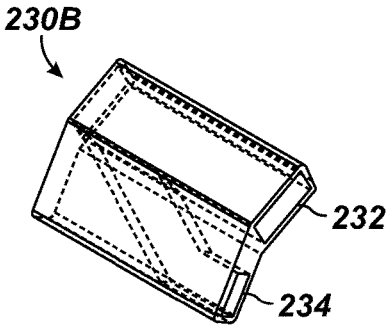
FIG. 6 illustrates a perspective view of an insert for the arrangement in FIG. 5.
Figure 7A:
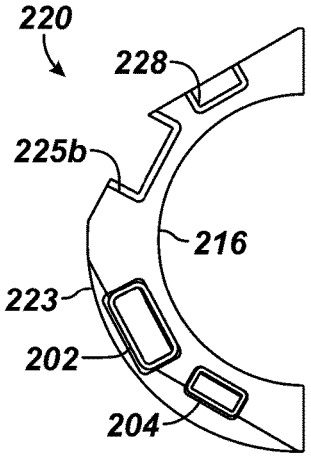
FIGS. 7A-7C illustrate an end view, an opposite end view, and a side view of the arrangement of FIG. 5 in different states of assembly.
Figure 7C:
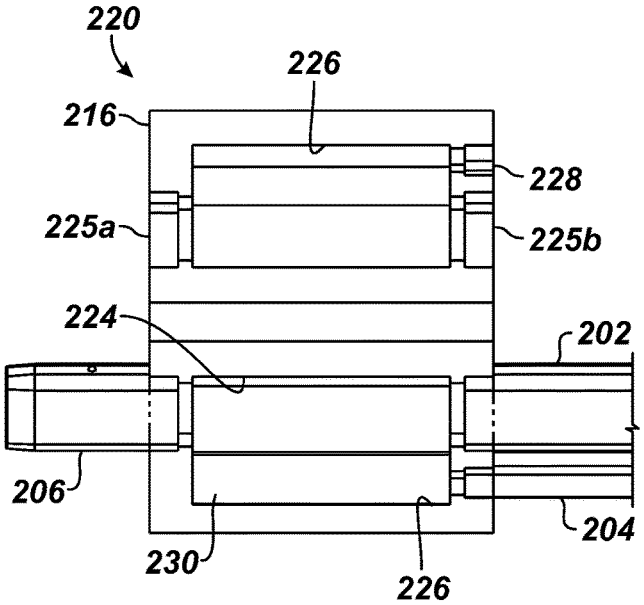
Figure 7B:
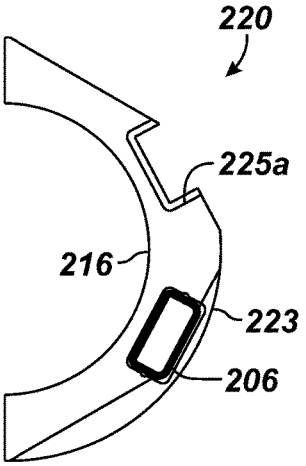

In this arrangement, a sheath 230B for the bypass 220 providing erosion resistance includes an insert 230B that positions in the slot 224 and side pocket 226 with the cover 223 used to enclose it therein. FIG. 6 illustrates an isolated perspective view of the sheath insert 230B of the arrangement in FIG. 5, and FIGS. 7A-7C illustrate an end view, an opposite end view, and a side view of the arrangement of FIG. 5 in different states of assembly.

The sheath insert 230B defines a first fluid passage 232 therethrough communicating the first tube opening 225*a* with the second tube opening 225*b*. The sheath insert 230B also defines a second fluid passage 234 therethrough communicating the first tube opening 225*a* with the third tube opening 228 for the pack tube 204. The sheath insert 230B can be composed of an erosion resistant material. Alternatively, sheath insert 230B can include a base material having a coating of erosion resistant material disposed on an inside surface of the first and second fluid passages 232, 234. Either way, the sheath insert 230B can mitigate direct erosion from the communicated slurry that would undermine the integrity of the top end ring 210, which is used for supporting the end of the screen (120) on the basepipe (110).

In this arrangement, the sheath insert 230B is directly encapsulated by the slot 224, the pocket 226, and the cover 223. Bonding or welding of the insert 230B to any of the elements may not be necessary, although it may be performed. Once all elements of slot 224, pocket 226, insert 230B, and cover 223 are mated together, the cover 223 is welded to the end ring segment 216. The transport and pack tubes 202, 204 and the tube stubs 206 are then inserted into receiving pockets 225*a-b*, 228 on the planar faces of the end ring 210 and are welded in place creating a sealed structure. In this way, the top end ring 210 includes the erosion resistant insert 230B that effectively isolates the flow from the top ring's base material.

Figure 8A:
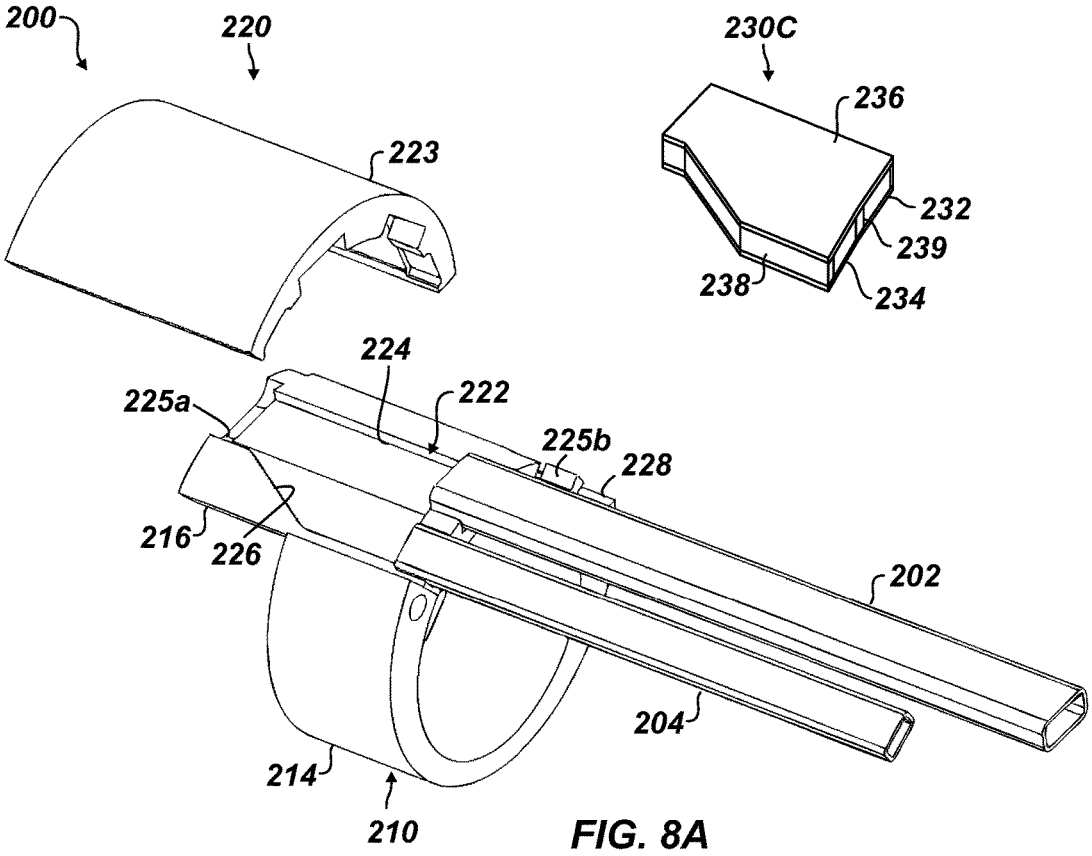
FIGS. 8A-8B illustrate an exploded view and a perspective view of another arrangement of the disclosed gravel pack assembly.
Figure 8B:
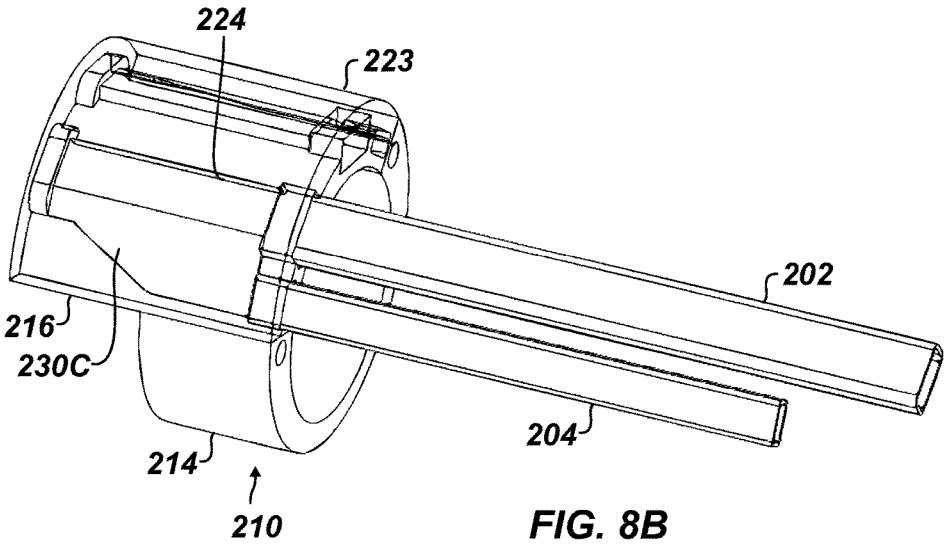

FIGS. 8A-8B illustrate an exploded view and a perspective view of another arrangement of the disclosed gravel pack assembly 200. The top end ring 210 is shown in isolation with truncated sections of the transport and pack tubes 202, 204 for illustrative purposes. The tube stub (206) is not shown. The end ring 210 has segments 214, 216 as before, and one of the segments 216 defines one or more channels 222 (slots 224 with side pockets 226) of the bypass 220 exposed externally thereon. The slot 224 defines the tube opening 225*a* for connection to the tube stub (206) and defines the other tube openings 225*b* for connection to the transport tube 202. The side pocket 226 communicates off of the side of the slot 224 to a third tube openings 228 on the end ring's second side for connection to the pack tube 204. The bypass 220 also includes a cover 223, which can enclose one or both of the externally exposed slots 224 with side pockets 226.

As best shown in FIG. 8A, the sheath 230C for the bypass 220 in this arrangement providing erosion resistance includes plates 230C of erosion resistant material to be installed in the slot 224 with side pocket 226 of the end ring 210, as opposed to the coating sheath 230A as in FIG. 4B and the block insert 230B of FIG. 5. The plates 230C includes top and bottom plates 236, sidewalls 238, and a divider wall 239 to form the main and side fluid passages 232 and 234.

These plates 230C can be composed of an erosion resistant material, such as a ceramic, tungsten carbide, or a similar erosion resistant material that is affixed to the inside surfaces of the slot 224 with side pocket 226 (and the underside of the cover 223 as the case may be) using welding, brazing, or other form of affixing. In some forms of manufacture, for example, the plates 230C can be affixed by a brazing technique. To braze the plates 230C in the slot 224 with side pocket 226, the plates 230C are cleaned and polished so the surfaces are wettable for brazeability. The material—typically 316 stainless steel—insides the slot 224 and pocket 226 are also cleaned. Brazing alloy and flux are then used to braze the plates 230C on the inside surface of the slot 224, pocket 226, and cover 223. The brazing alloy used can be any suitable alloy for the application at hand and can be composed of a silver-based braze suited for 300-series stainless steels.

If desired and for reasons similar to those noted further below with respect to FIGS. 13A through 17, features in FIGS. 4A-4B, 5, 6, 7A-7C, and 8A-8B for the channel 222, slots 224, pockets 226, sheaths or inserts 230, and covers 220 can be shared between all of the tubes 202, 204, and 206 together as opposed to being compartmentalized or divided, thereby forming a commingling chamber in the end ring 200 communicating with all of the various openings for the tubes 202, 204, and 206.

Figure 9A:
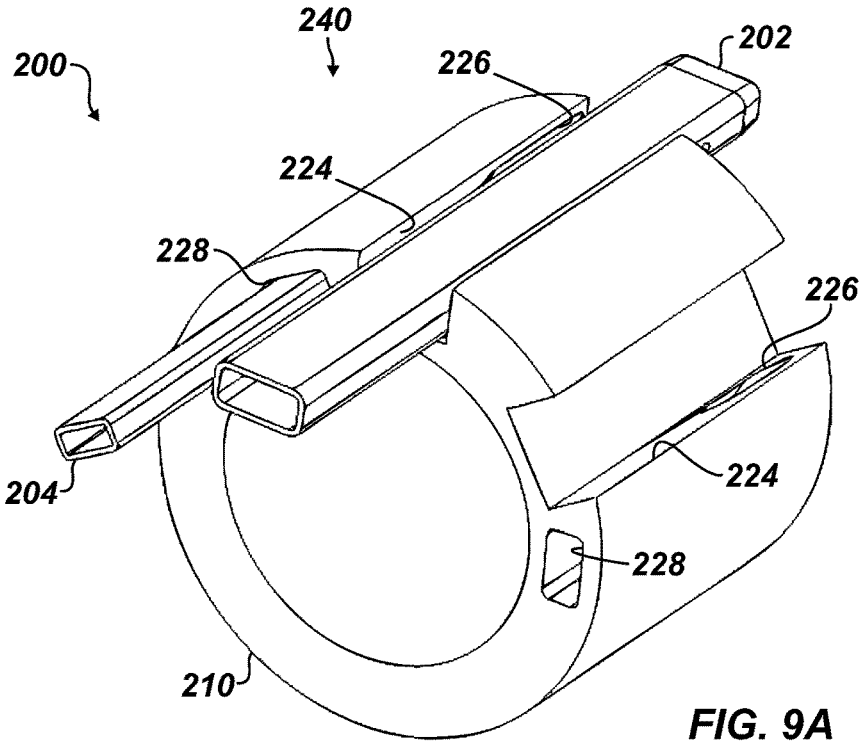
FIG. 9A-9B illustrate a perspective view and a partially exposed view of yet another arrangement of the disclosed gravel pack assembly.
Figure 9B:
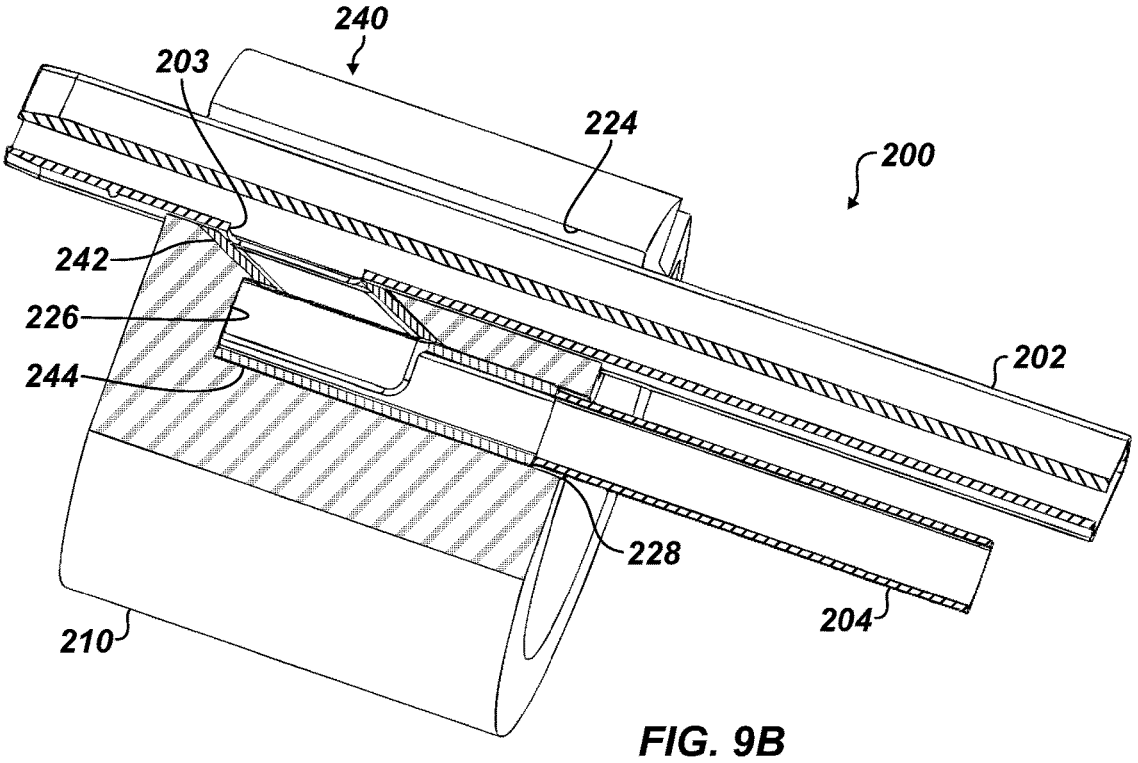
Figure 9C:
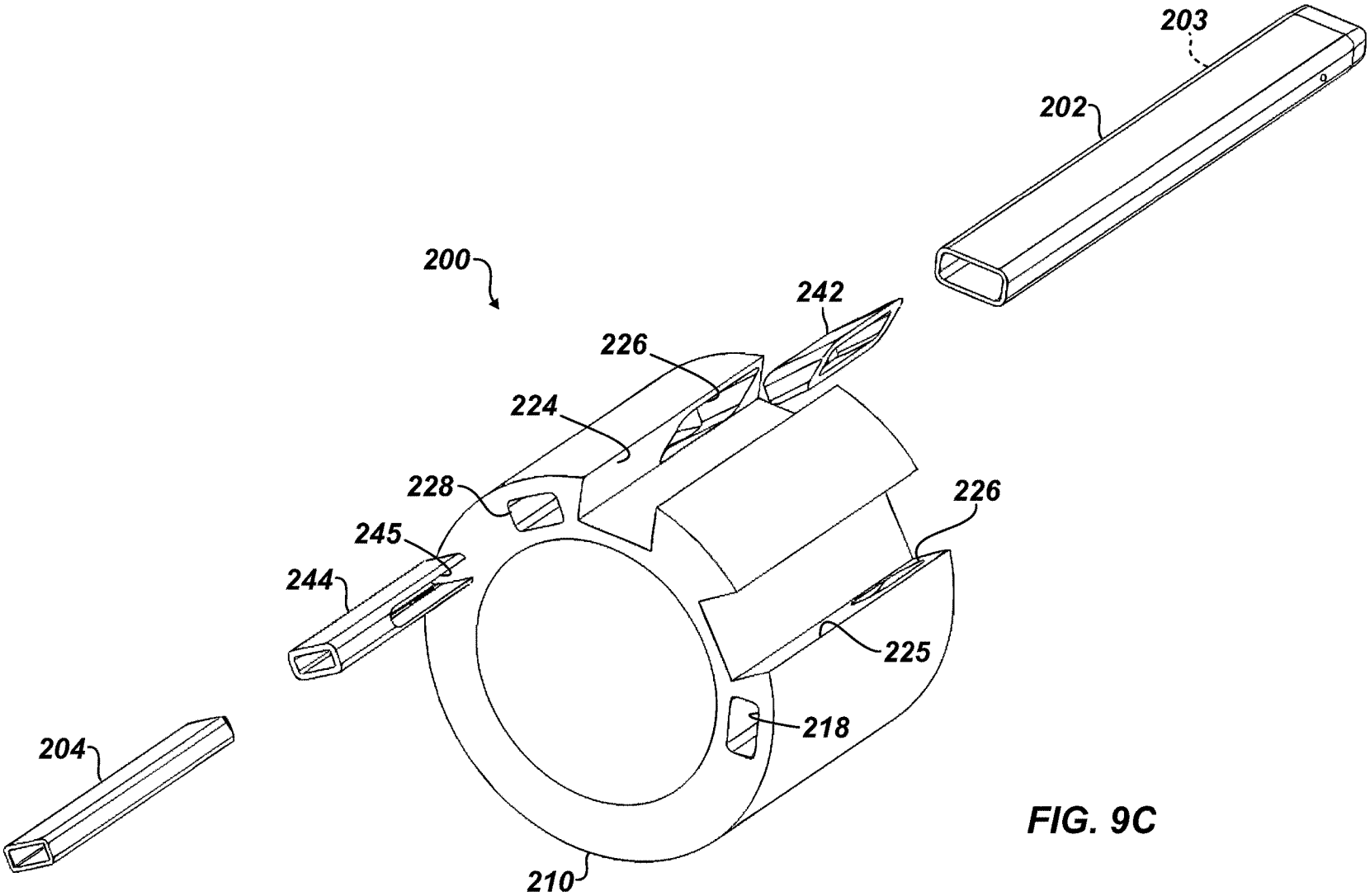
FIG. 9C illustrate an exploded view of the arrangement in FIGS. 9A-9B.

FIG. 9A-9B illustrate a perspective view and a partially exposed view of yet another arrangement of the disclosed gravel pack assembly 200. FIG. 9C illustrate an exploded view of the assembly 200 in FIGS. 9A-9B. The assembly 200 includes an end ring 210, which may or may not be comprised of segments. The end ring 210 defines one or more channels 222 (slots 224 with side ports 226). A transport tube 202 positions in the slot 224. A cover may not be necessary for the end ring 210 because various features of the channel 222 (slot 224, side pocket 226, and tube opening 228) can be formed in the end ring 210 to accommodate a transport tube 202, a pack tube 204, and a bypass 240.

As best shown in FIG. 9B, the transport tube 202 defines a side port 203 communicating off of the tube's fluid bore for alignment with the side pocket 226 defined in the end ring 210. The bypass 240 include a sheath or body being at least partially erosion resistant and positioned in the side pocket 226 at the side port 203 of the transport tube 202 for communicating slurry to a pack tube 204 at the tube opening 228.

As best shown in FIGS. 9B-9C, the bypass 240 includes separate components of an angled insert 242 and a pocket insert 244 that install separately into the end ring's pocket 226. The angled insert 242 fits into the side pocket 226 at the slot 224 for communicating with the side port 203 of the transport tube 202. The pocket insert 244 installs in the side pocket 226 by inserting through the tube opening 228 in the end of the end ring 210. As best shown in FIG. 9C, the pocket insert 244 can include a cutout 245 for aligning with the angled insert 242. Finally, the pack tube 204 installs with its end in the tube opening 228 and welds in place.

For assembly, the two inserts 242, 244 installed separately into the end ring 210 may not be affixed together. If desired, the pocket insert 244 can be part of or attached to the end of the pack tube 204, although this is not strictly necessary as the pack tube 204 preferably welds into the tube opening 228. The angled insert 242 would typically need to be installed in the pocket 226 at the slot 224 before the transport tube 202 installs in the slot 224. Once the tube 202 is installed, however, the angled insert 242 can be welded to the tube 202.

Figure 10:
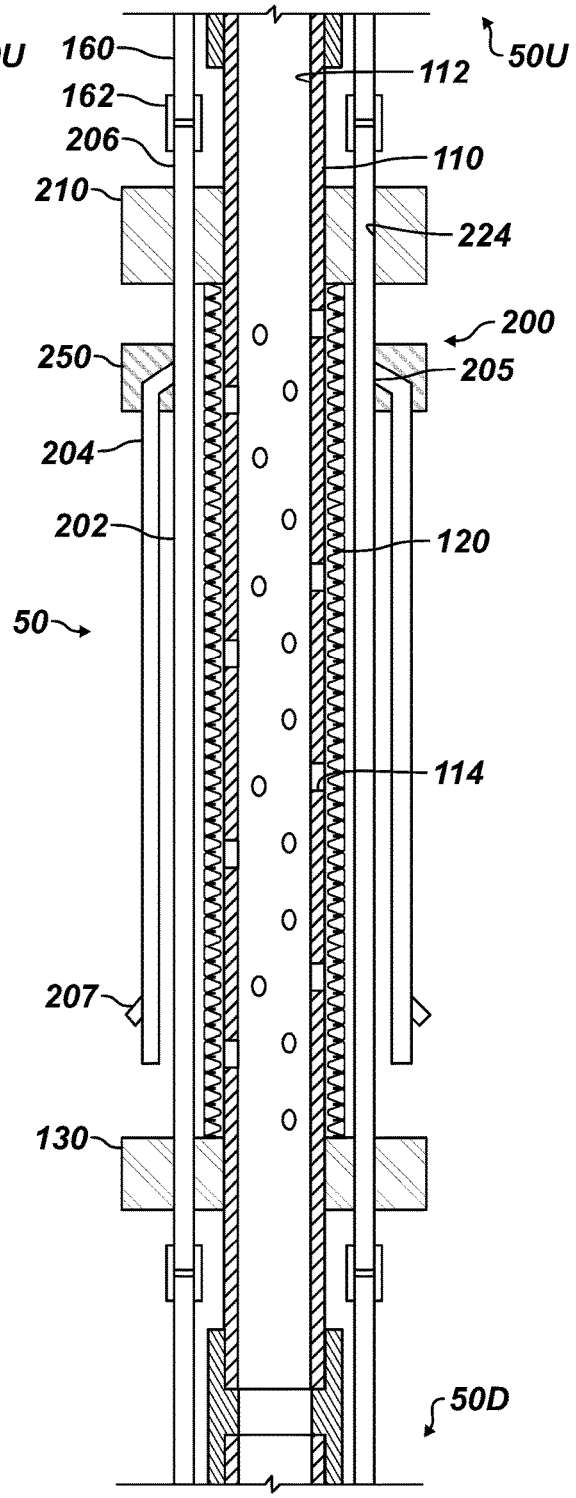
FIG. 10 illustrates a wellscreen having a gravel pack assembly according to another embodiment of the present disclosure.

Turning to FIG. 10, another embodiment of the gravel pack assembly 200 is illustrated for delivering slurry along a basepipe 110 of a wellscreen 50. As before, the wellscreen 50 includes tubing or basepipe 110 with perforations 114 in its throughbore 112. A filter or screen 120 is disposed about the basepipe 110 to screen fluid flow through the perforations 114 and into the throughbore 112. End rings 210 and 130 support the screen 120 on the basepipe 110.

The gravel pack assembly 200 delivers slurry along the basepipe 110 of the wellscreen 50 for gravel packing a wellbore annulus around the screen 120. The assembly 200 includes the top end ring 210, a transport tube 202, a pack tube 204, and a bypass 250. Slurry from an uphole wellscreen 50U is delivered by jumper tubes 160 connected by connectors 162 to ends of the transport tubes 202 extending beyond the top end ring 210. The bypasses 250 communicate delivered slurry from the transport tubes 202 to the pack tubes 204.

The top ring 210 positions about the basepipe 110, and the transport tube 202 extends from the end ring 210 along the basepipe 110 and defines a fluid bore therethrough for conveying the slurry. In this configuration, the top end ring 210 provides mechanical support for the transport tubes 202, and the bypasses 250 act as flow splitters installed downstream of the top ring 210. The bypasses 250 split the flow so portion of the slurry can move from the transport tubes 202 to the pack tubes 204. Like the transport tubes 202, the pack tubes 204 extend in fluid communication from the bypasses 250 along the tubing 110 of the wellscreen 50. To actually deliver the slurry for the gravel pack to the annulus, the pack tubes 204 have at least one outlet port or nozzle 207.

The bypasses 250 are disposed on the transport tubes 202 and include sheaths that are at least partially erosion resistant to divert a portion of the conveyed slurry from the transport tubes 202 to the pack tubes 204. In one arrangement, the erosion resistant sheaths of the bypasses 250 include a hard face or coating on an internal surface in fluid contact with the slurry to isolate the slurry's flow from the bypasses' base material. In an alternative, the bypasses 250 are composed of an erosion resistant base material that acts as the erosion resistant sheath according to the disclosed purposes.

Construction and assembly of the wellscreen 50 can be similar to that disclosed above with reference to FIG. 3 so the details are not repeated here. Here, the top end ring 210 positioned about the basepipe 110 defines one or more slots 224. The one or more transport tubes 202 position in the slots 224, and the transport tubes 202 define side ports 205 communicating off of the tube's fluid bore. The bypasses 250 include a sheath or body being at least partially erosion resistant and positioned on the transport tube 202 at the side port 205.

Figure 11A:
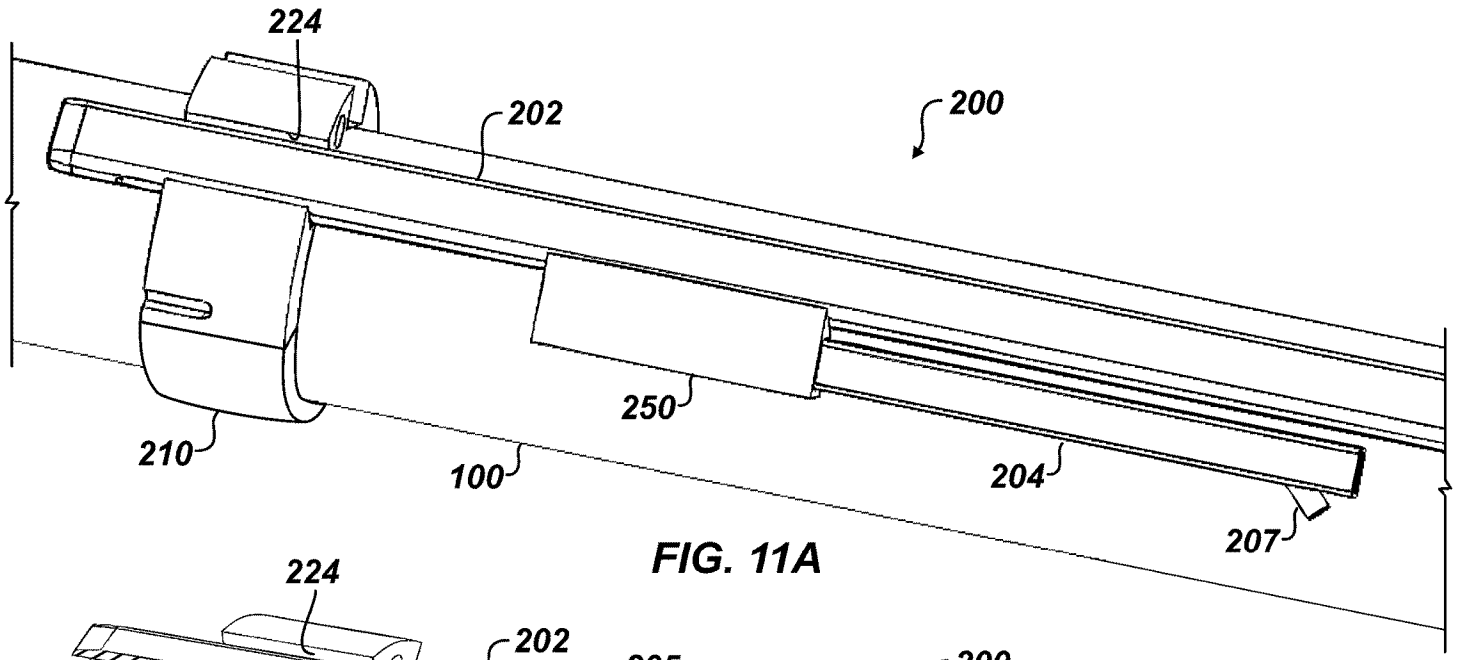
FIGS. 11A-11B illustrate a perspective view and a partially exposed view of one arrangement of the disclosed gravel pack assembly.
Figure 11B:
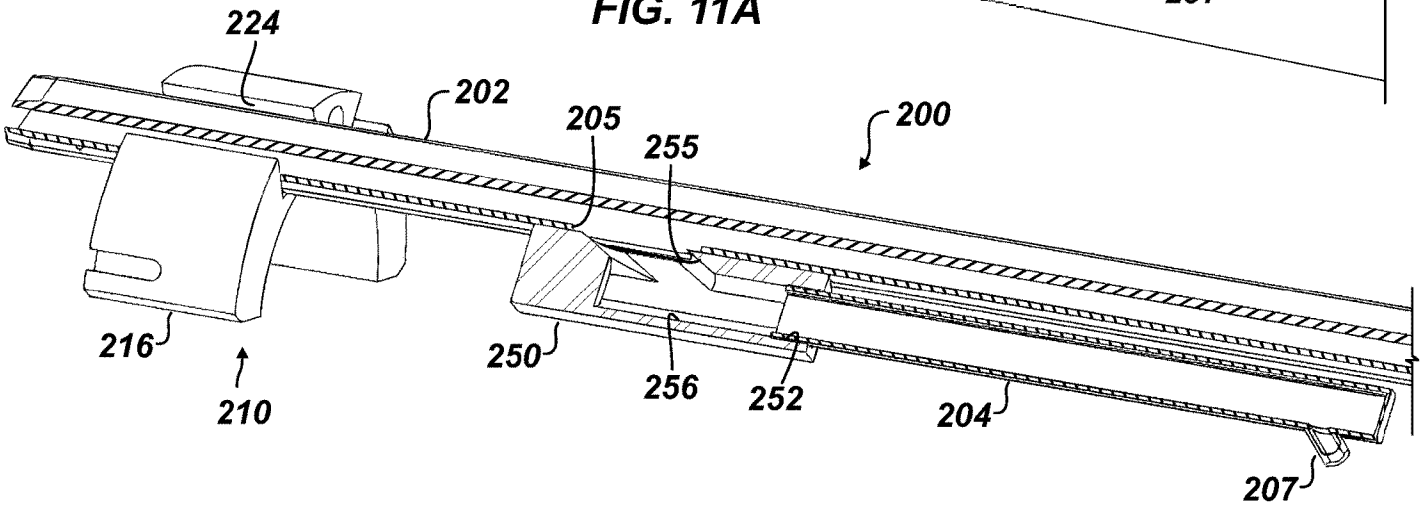

For example, one arrangement of the disclosed gravel pack assembly 200 is illustrated in a perspective view and a partially exposed view of FIGS. 11A-11B. In FIG. 11A, the top end ring 210 is shown in isolation with transport and pack tubes 202, 204 for illustrative purposes. As before, the top end ring 210 can have two or more segments 214, 216 that affix together about the basepipe 110. The transport tubes 202 pass through slots 224 in the end ring 210 and extend along the length of the basepipe 110. The bypasses 250 are disposed on the side of the transport tubes 202, and the pack tubes 204 extend from the bypasses 250. In FIG. 11B, one of the segments 216 is shown in isolation with the transport tube 202, the pack tube 204, and the bypass 250 illustrated in exposed cross-section.

The bypass 250 is a body disposed on the transport tube 204 at a side port 205. The bypass 250 defines a pocket 256 having a side port 255 and a tube opening 252. The body's side port 255 communicates with the tube's side port 205, and the pack tube 204 positions in fluid communication with the tube opening 252 on the bypass 250.

As shown, the pocket 256 forms a channel or bypass passage from the side port 255 to the tube opening 252 that comprises an angled section communicating off the side port 255 and comprises a longitudinal section communicating the angled section with the tube opening 252. Slurry from the transport tube 202 can exit out of the side port 205 and be delivered by the pocket 256 of the bypass 250 to the pack tube 204. As shown, the pack tube 204 can include an enclosed end and can having one or more outlets or nozzles 207 for exiting slurry.

The bypass 250 can be composed of erosion-resistant material. Alternatively, the bypass 250 can be composed of another base material, such as the same material as the transport tube 202, but the bypass 250 can include a sheath of an erosion resistant material disposed on, formed on, or coated on an inside surface of the channel or pocket 256 in ways similar to those disclosed previously. Moreover, the bypass 250 can be composed of a base material, and separate angled and pocket inserts (e.g., 242, 244) of the arrangement in FIGS. 9A-9C can be composed of erosion-resistant material and can used in the port 255 and pocket 256 of the bypass 250.

Figure 12A:
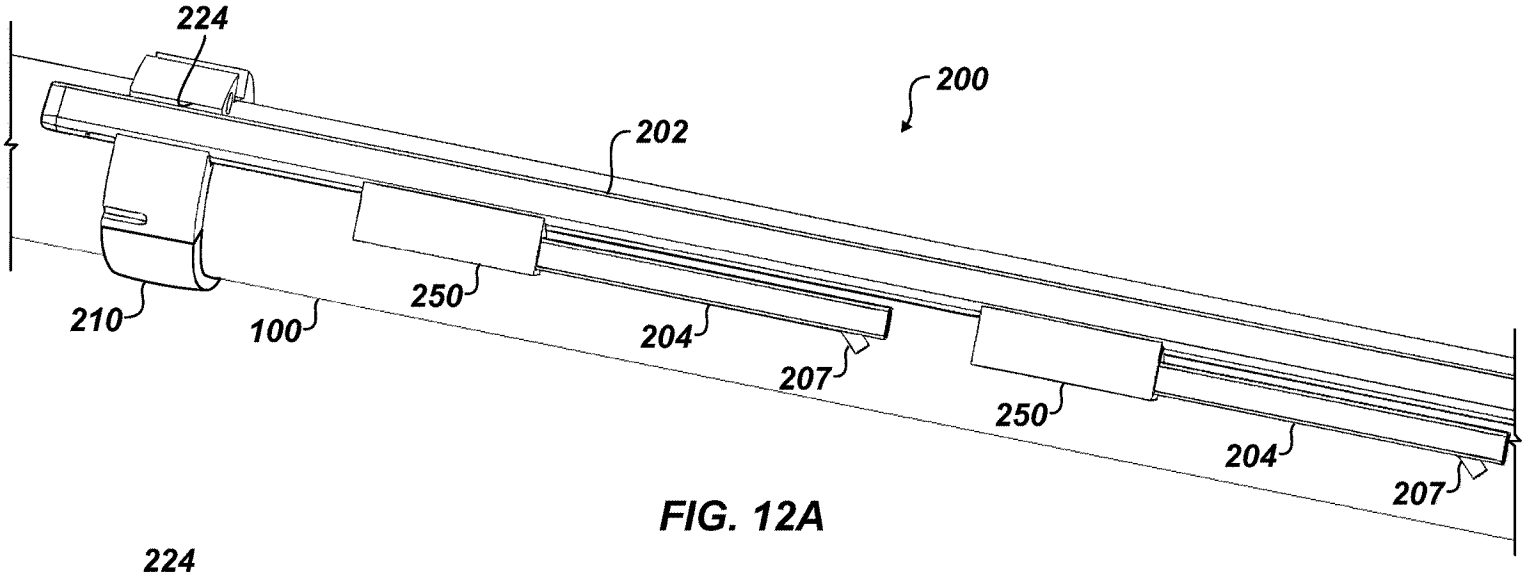
FIGS. 12A-12B illustrate an exploded view and a perspective view of another arrangement of the disclosed gravel pack assembly.
Figure 12B:
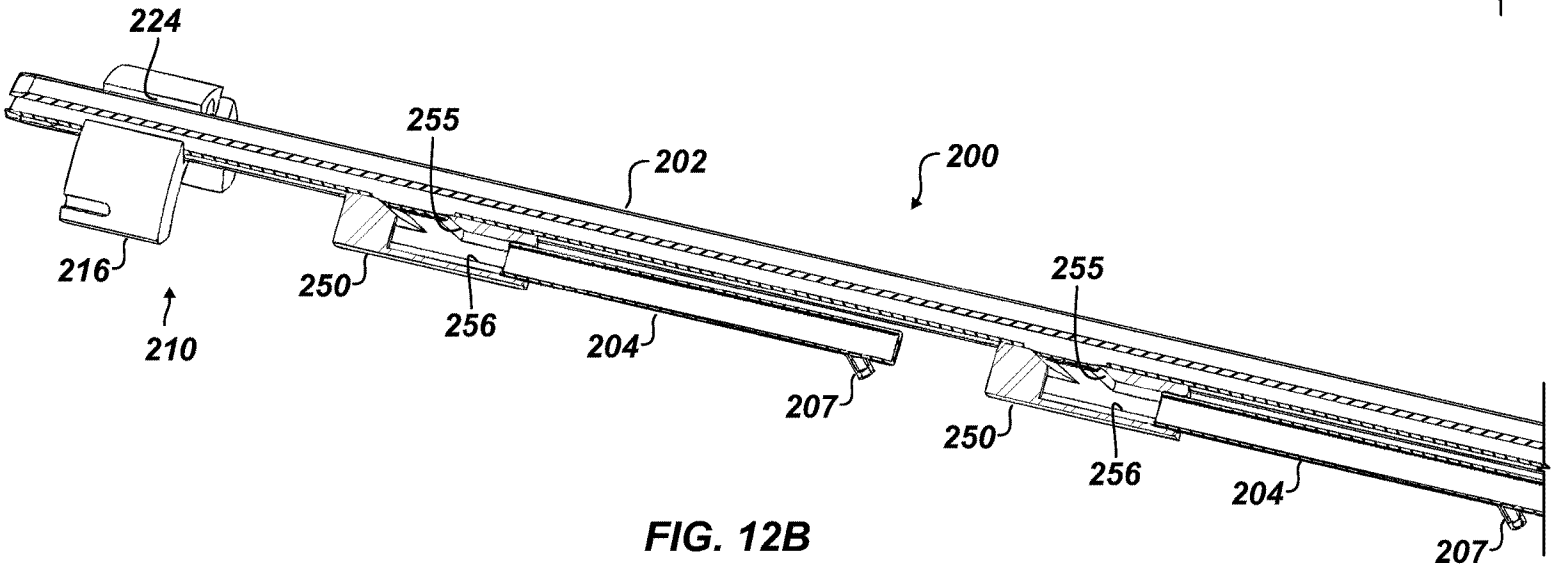

As shown in FIGS. 12A-12B, more than one combination of bypass 250 and pack tube 204 can be spaced along the length of the transport tube 202, such as the two shown here. More can be provided depending on the length of the wellscreen 50. Although the pockets 256 may include erosion-resistant sheaths or the like as disclosed herein, it should be recognized that the arrangement here with more than on bypass 250 and pack tube 204 on a transport tube 202 may not require particular erosion-resistance for the pockets 256 apart from that of the base metal. This because the arrangement may already result in better pressure distribution that would lead to decreased erosion.

As seen in FIGS. 3-12B, the gravel pack system 200 may place one nozzle 207 individually on a pack tube 204 which is fed by a transport tube 202. Accordingly, for a given zone, each nozzle 207 on its independent pack tube 204 can be fed by the transport tube 204 via its own bypass 220, 250. Better slurry transport and delivery can result from this arrangement, which may have merit on its own apart from (and additional to) use of erosion resistance as disclosed herein. For instance, although the channels 222 with slots 224 and pockets 226 in FIG. 4B may include erosion-resistant sheaths or the like as disclosed herein, it should be recognized that the arrangement may not require particular erosion-resistance for the channels 226 apart from that of the base metal because the arrangement may already result in better pressure distribution that would lead to decreased erosion.

The gravel pack assemblies 200 and wellscreens 50 of the present disclosure can be used in open-hole or cased-hole applications. As will be appreciated, the joints of the wellscreens 50 have timed threads so that the various shunt tubes, jumper tubes, tube stubs, transport tubes, pack tubes, etc. can be aligned with one another along the assembly 200 as the joints are made up. Moreover, a protective shroud or split cover (not shown) can be disposed on the wellscreens 50 to cover the gravel pack assembly 200. Although these and other features of a wellscreen may not be shown in the figures, their use, purpose, and inclusion would be understood by a person of ordinary skill in the art having the benefit of the present disclosure.

FIGS. 13A-13C illustrate a side view, a partial cross-sectional view, and an end sectional view of a wellscreen 50 having at least one ring 300A for commingling the conveyed slurry of a gravel pack assembly according to the present disclosure. The wellscreen 50 includes tubing or basepipe 110, and rings 300A-C support a shroud 140 on the basepipe 110. Preferably and as shown in FIG. 13C, the rings 300A-C, shroud 140, and the like are arranged concentric to the basepipe 110.

A gravel pack assembly delivers slurry along the basepipe 110 of the wellscreen 50 for gravel packing a wellbore annulus. The assembly can be an extended-reach, externally-shunted system. The assembly includes one or more transport tubes 307 extending along the length of the tubing 110 between the rings 300A-C. The assembly also includes one or more tubes or stubs 305 extending outward from each of the end rings 300A-B in to the blank area of the wellscreen 50. As is typical, these tube stubs 305 can be used for connection to jumper tubes (not shown) or other form of communication with wellscreens (not shown) coupling to the depicted wellscreen 50.

In use, slurry from an uphole wellscreen can be delivered by jumper tubes connected by connectors (not shown) to tube stubs 305 on the top ring 300A. The connectors may use features including lugs, fasteners, locks, snap collets, snap rings, and the like to connect the ends of the transport tube stubs 305 and the jumper tubes together. The top ring 300A commingles the delivered slurry in a commingle chamber 302 and communicates the delivered slurry to the transport tubes 307. The commingle chamber 302 is at least partially erosion resistant. In one arrangement, the chamber 302 uses a hard face or coating on an internal surface of the top ring 300A in fluid contact with the slurry to isolate the slurry's flow from the top ring's base material. In an alternative, the chamber 302 include an erosion resistant insert that effectively isolates the flow from the top ring's base material.

As shown, the transport tubes 307 extend from the top ring 300A along the basepipe 110 and conveying the slurry to the downhole end of the wellscreen 50. In general and as shown, the transport tubes 307 may pass through slots in the intermediate 300C and in the bottom ring 300B so distal ends of the tubes 307 can connect to jumper tubes (not shown) that deliver the slurry across a joint to a downhole wellscreen.

As an alternative to having only the top ring 300A be chambered, the bottom ring 300B may be similar to the top ring 300A and may also have a commingle chamber (302) that commingles the delivered slurry from the transport tubes 307 and communicates the commingled slurry to tube stubs for connecting to jumper tubes (not shown). The intermediate ring 300C may also be similar and have a commingle chamber (302).

FIGS. 14A-14C illustrate a side view, a partial cross-sectional view, and an end sectional view of a wellscreen 50 having at least one ring 300A for commingling the conveyed slurry of a gravel pack assembly according to the present disclosure. Again, the wellscreen 50 includes tubing or basepipe 110, and rings 300A-B support a shroud 140 on the basepipe 110. Additionally, one or more filters or screens 120 are disposed about the basepipe 110 to screen fluid flow through the perforations 114 and into the throughbore 112. End rings 130 support the screens 120 on the basepipe 110. Preferably and as shown in FIG. 14C, the rings 300, the shroud 140, and the like are arranged concentric to the basepipe 110.

A gravel pack assembly delivers slurry along the basepipe 110 of the wellscreen 50 for gravel packing a wellbore annulus about the filters 120. The assembly includes one or more transport tubes 307 extending along the length of the tubing 110 between the rings 300A-C. Additionally, the assembly includes one or more pack tubes 309 extending at least partially along the length of the tubing 110 between the rings 300A-C.

Finally, the assembly also includes one or more tubes or stubs 305 extending outward from each of the top ring 300A into the blank area of the wellscreen 50. As is typical, these tube stubs 305 can be used for connection to jumper tubes (not shown) or other form of communication with wellscreens (not shown) coupling to the depicted wellscreen 50.

In use, slurry from an uphole wellscreen can be delivered by jumper tubes connected by connectors (not shown) to the tube stubs 305 on the top ring 300A. The connectors may use features including lugs, fasteners, locks, snap collets, snap rings, and the like to connect the ends of the transport tube stubs 305 and the jumper tubes together. The top ring 300A commingles the delivered slurry in a commingle chamber 302 and communicates the delivered slurry to the transport tubes 307 and the pack tubes 309. The commingle chamber 302 is at least partially erosion resistant. In one arrangement, the chamber 302 uses a hard face or coating on an internal surface of the top ring 300A in fluid contact with the slurry to isolate the slurry's flow from the top ring's base material. In an alternative, the chamber 302 include an erosion resistant insert that effectively isolates the flow from the top ring's base material.

As shown, the pack tubes 309 extend from the top ring 300A along the basepipe 110 and conveying the slurry to the annular area around the filters 120. Also, the transport tubes 307 extend from the top ring 300A along the basepipe 110 and conveying the slurry to the downhole end of the wellscreen 50. In general and as shown, the transport tubes 309 may pass through slots in the intermediate ring 300C and in the bottom rings 300B so distal ends of the tubes 307 can connect to jumper tubes (not shown) that deliver the slurry across a joint to a downhole wellscreen. The pack tubes 309 may also pass through slots in the intermediate ring 300C. (Leak off tubes are shown in additional slots in the bottom ring 300B.)

As an alternative to having only the top ring 300A be chambered, the bottom ring 300B may be similar to the top ring 300A and may also have a commingle chamber (302) that commingles the delivered slurry from the transport tubes 307 and communicates the commingled slurry to tube stubs for connecting to jumper tubes (not shown). The intermediate ring 300C may also be similar and have a commingle chamber (302).

According to the disclosed assembly, the rings 300 with the chambers 302 comingle the slurry at some point on the wellscreen 50 and not over the blank sections where one wellscreen 50 is connected to another wellscreen. For example, a chambered ring 300 in FIGS. 13A-13C can be located at the top ring 300A, the intermediate ring 300C, and/or the bottom ring 300B. The chamber 302 provides commingling for the transport tubes 307.

Likewise, any one or more of the rings 300A-C in FIGS. 14A-14C can be chambered. Preferably, a chambered ring 300 can be located at the top ring 300A and can provide commingled communication of slurry for both the transport tubes 307 and the pack tubes 309. If desired, a chambered ring 300 can be located at the intermediate ring 300C and can also provide commingled communication of slurry for both the transport tubes 307 and the pack tubes 309. Finally, if desired, a chambered ring 300 can be located at the bottom ring 300B and can provide commingled communication of slurry for the transport tubes 307.

In general, the rings 300 are concentric to the wellscreen's basepipe 110. Also, the rings 300 can also support end(s) of shroud(s) 140, which is disposed concentrically about the tubing 110 of the wellscreen 50. In other arrangements, the rings 300 can be eccentric to the basepipe 110 so that the commingling chamber 302 can be eccentric as well. This eccentric chamber 302 represents a segment of the wellscreen's circumference closely aligned with the more than one transport tubes 307. The eccentric chamber 302 can be as wide, as long, and as tall as is feasible and necessary while maintaining the functionality of the wellscreen 50.

In either case, the chamber 302 is sized to minimize a pressure drop in the flow of slurry as well as to minimize risks of plugging and erosion. As already noted, more than one of the chambered rings 300 with a comingling chamber 302 can be used on each wellscreen 50. As already noted, the commingling chamber 302 can communicate the slurry to the transport tubes 307 as well as the pack tubes 309. Nozzles can be put directly on the chambered ring 300 to communicate the chamber 302 with the annulus around the wellscreen 50. Finally as already noted, a sheath in the form of material, cladding, insert, and the like can be added to the chamber 302 to prevent erosion even though the disclosed arrangements may not require particular erosion-resistance for the chambers 302 apart from that of the base metal. This is because the configurations may result in better pressure distribution that would lead to decreased erosion.

Having an understanding of the arrangements of rings 300 having commingle chambers 302 and used with a gravel pack assembly on a wellscreen 50, discussion turns to particular features of the rings 300.

Figure 15A:
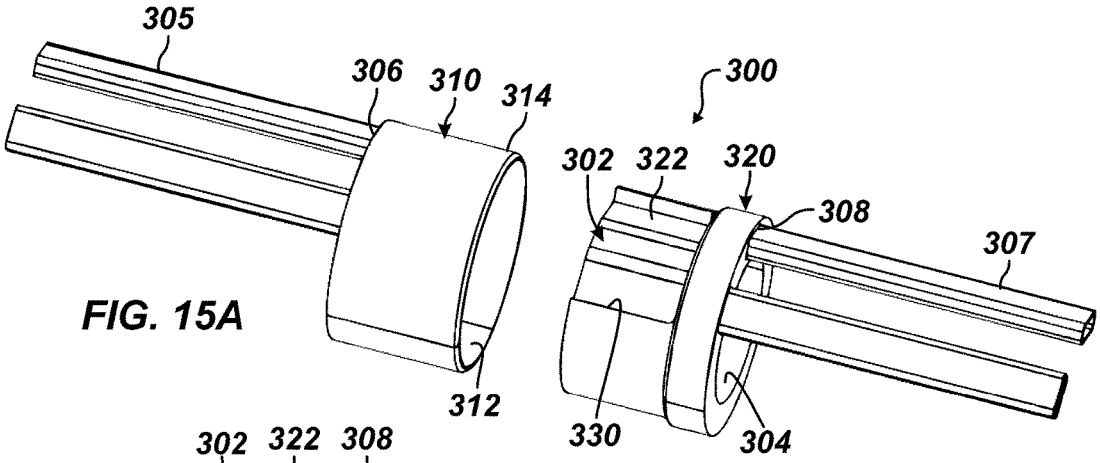
FIGS. 15A-15C illustrate a first perspective view, a second perspective view, and an end-sectional view of a ring and tubes for commingling conveyed slurry according to one embodiment of a gravel pack assembly to the present disclosure.
Figure 15C:
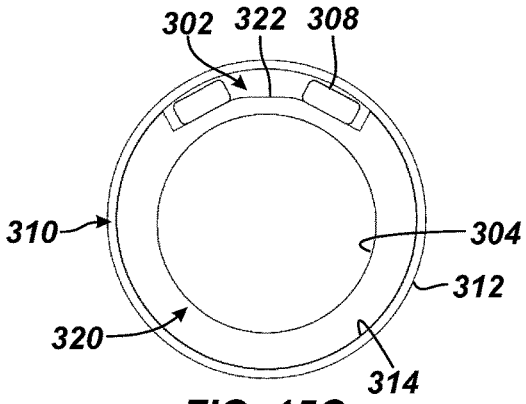
Figure 15B:
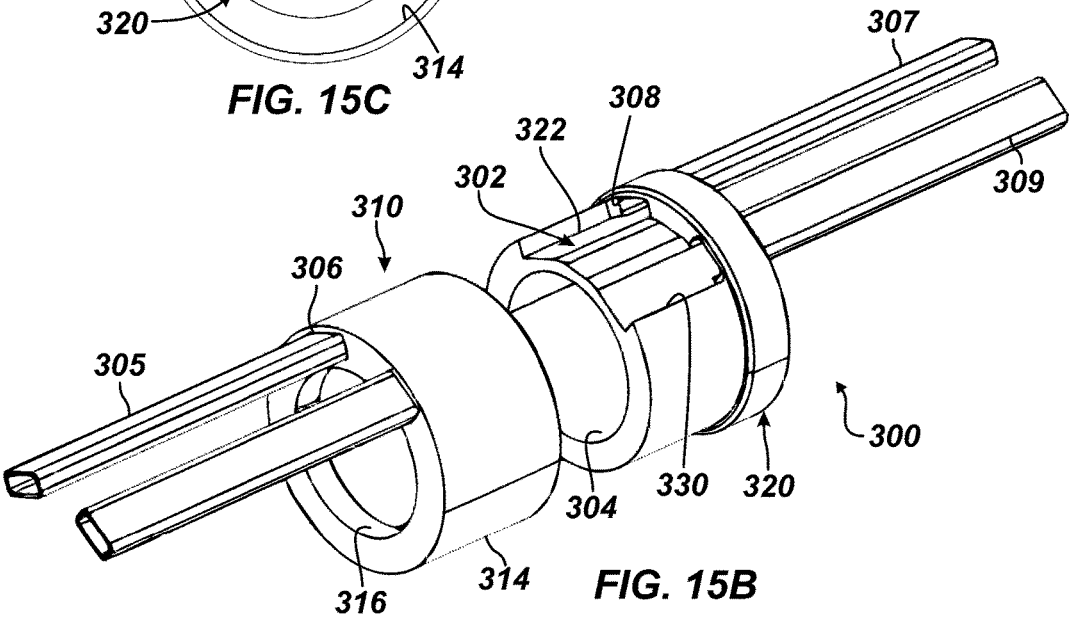

FIGS. 15A-15C illustrate a first perspective view, a second perspective view, and an end-sectional view of a ring 300 and tubes 305, 307 for commingling conveyed slurry according to one embodiment of a gravel pack assembly to the present disclosure. This arrangement can be used, for example, with the wellscreen (50) depicted in FIGS. 13A-13C, which lacks pack tubes to pack the annular area.

The ring 300 is disposed on tubing (not shown) of the wellscreen. The ring 300 has first and second ring sections 310, 320 that affix together using welding, fasteners, or other connecting mechanism. Each of these ring sections 310, 320 can have segments that facilitate their placement and attachment to the tubing using welding or other means of affixing. Of course, the sections 310, 320 need not be segmented depending on how they are assembled on the wellscreen. The first ring section 310 positions at least partially on the second ring section 320, and the first and second ring sections 310, 320 disposed together define a chamber 302 therein.

For example, the first (female) ring section 310 has an internal passage 312 that fits around the tubing (not shown). The first ring section 310 has a sleeve portion 314 in which a ledge portion of the second (male) ring section 320 fits. An end face 316 encloses around the tubing, whereas the sleeve 314 of the section 310 encloses around the second section 320. For its part, the second section 320 includes an external pocket 322 formed therein so that the sleeve 314 and pocket 322 create the chamber 302 inside the coupled sections 310, 320.

With the ring sections 310, 320 fit together, the chamber 302 has first tube openings 306 on a first side of the first ring section 310 has second tube openings 308 on a second side of the second ring section 320.

First tubes 305 for conveying the slurry have ends positioned (connected) in fluid communication with the first tube openings 306. These tubes 305 position along the tubing of the wellscreen. Second tubes 307 for conveying the slurry have ends positioned (connected) in fluid communication with the second tube openings 308. These tubes 307 also position along the tubing of the wellscreen.

In terms of one arrangement, the ring 300 can be a top ring (e.g., 300A in FIGS. 13A-13C) on the wellscreen (50) in which case (a) the first tubes 305 can be tube stubs for connecting to jumper tubes in the blank area of the wellscreen and (b) the second tubes 307 can be transport tubes for extending along the wellscreen. The opposite arrangement is possible, and the ring 300 can be a bottom ring (e.g., 300B in FIGS. 13A-13C) on the wellscreen. Moreover, both the first and second tubes 305, 307 can be transport tubes in which case the ring 300 can be an intermediate ring (e.g., 300C in FIGS. 13A-13C) on the wellscreen.

Preferably and as shown in FIG. 15C, the ring 300 is arranged to fit concentrically on the wellscreen's tubing, which passes through the ring's throughbore 304. Additionally and as best shown in FIGS. 15A-15B, the chamber 302 formed from the pocket 322 and the internal surface of the sleeve 314 preferably includes an erosion resistant sheath 330, such as disclosed herein.

Figure 16A:
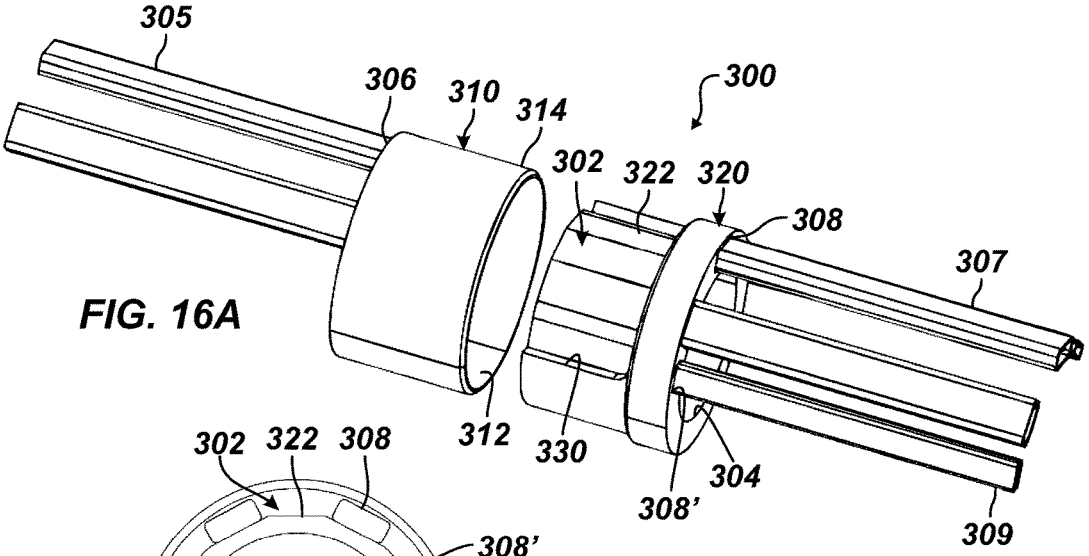
FIGS. 16A-16C illustrate a first perspective view, a second perspective view, and an end-sectional view of a ring and tubes for commingling conveyed slurry according to another embodiment of a gravel pack assembly to the present disclosure.
Figure 16C:
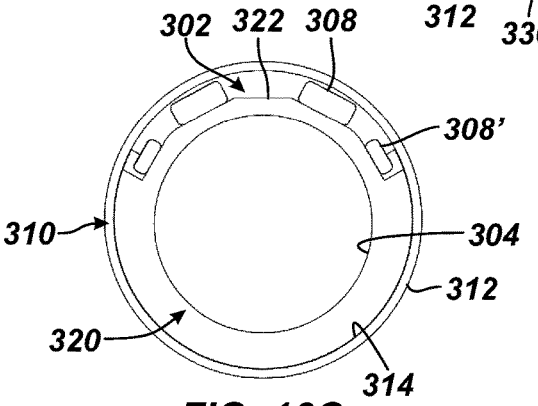
Figure 16B:
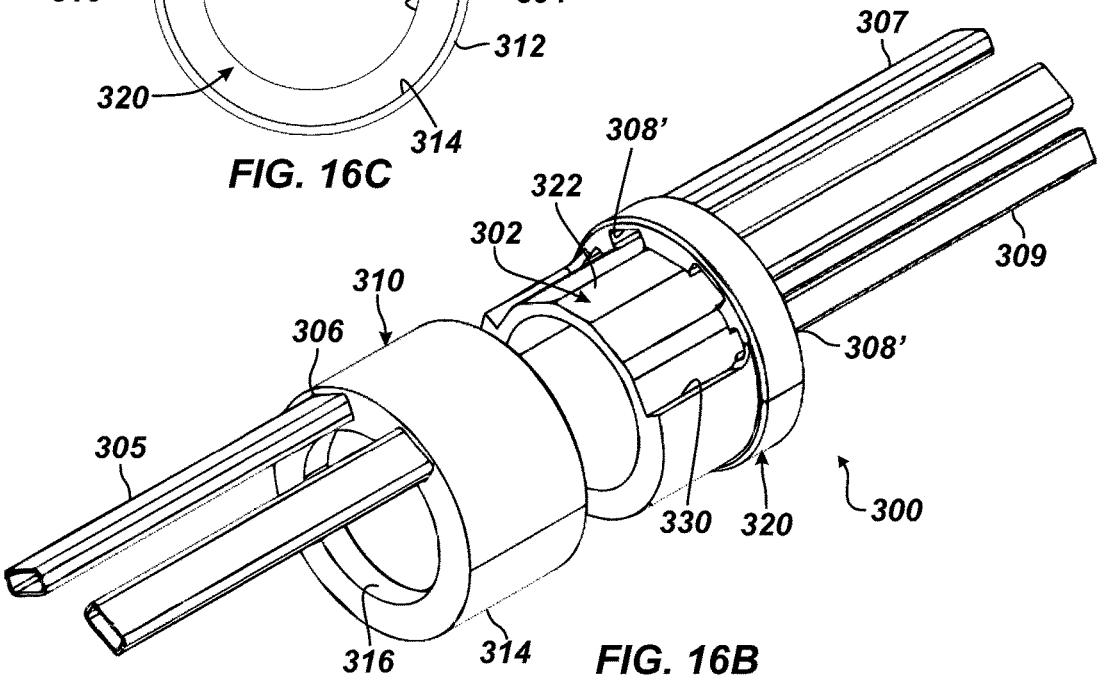

FIGS. 16A-16C illustrate a first perspective view, a second perspective view, and an end-sectional view of a ring 300 and tubes 305, 307, and 309 for commingling conveyed slurry according to another embodiment of a gravel pack assembly to the present disclosure. This arrangement can be used, for example, with the wellscreen (50) depicted in FIGS. 14A-14C, which has pack tubes 309 to pack the annular area.

As before, the ring 300 is disposed on tubing (not shown) of the wellscreen, and the ring 300 has first and second ring sections 310, 320. These and other features are similar to those discussed above and are reincorporated herein. In contrast to the previous arrangement, the chamber 302 of the ring 300 here communicates with at least one third tube opening 308'on the second side of the second ring section 320. At least one third tube 309 positions in fluid communication with the at least one third tube opening 308' and positions along the tubing of the wellscreen.

In terms of one arrangement, the ring 300 can be a top ring (e.g., 300A in FIGS. 14A-14C) on the wellscreen (50) in which case (a) the first tubes 307 can be tube stubs for connecting to jumper tubes in the blank area of the wellscreen, (b) the second tubes 307 can be transport tubes for extending along the wellscreen, and (c) the third tubes 309 can be pack tubes for delivering slurry to the annulus. Of course, the ring 300 can be positioned elsewhere on the wellscreen's tubing and can be an intermediate ring (e.g., 300C in FIGS. 14A-14C).

Preferably and as shown in FIG. 16C, the ring 300 is arranged to fit concentrically on the wellscreen's tubing, which passes through the ring's throughbore 304. Additionally and as best shown in FIGS. 16A-16B, the chamber 302 formed from the pocket 322 and internal surface of the sleeve 314 preferably includes an erosion resistant sheath 330, such as disclosed herein.

Figure 17:
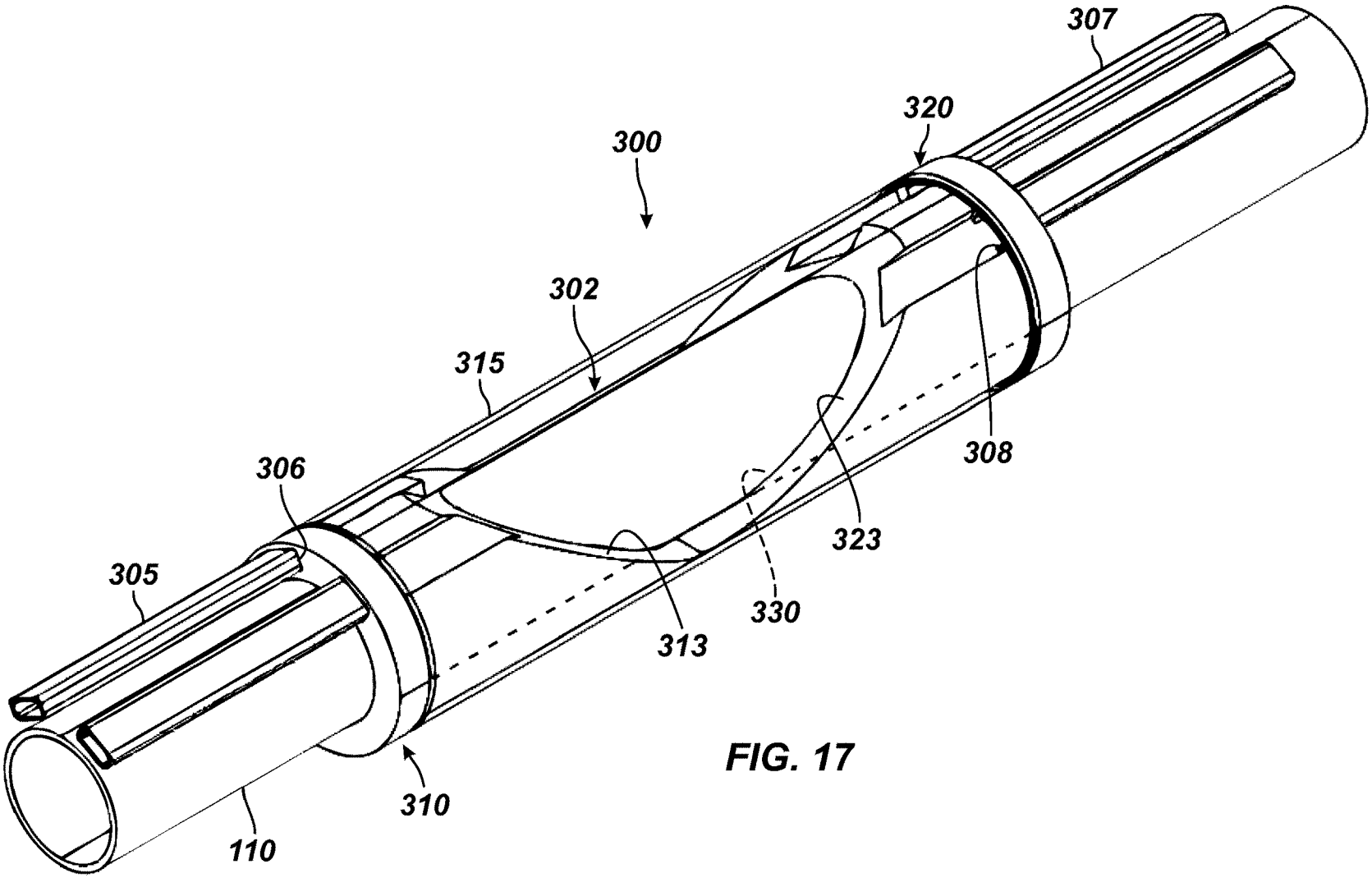
FIG. 17 illustrates a perspective view (partially exposed) of a ring and tubes for commingling conveyed slurry according to yet another embodiment of a gravel pack assembly to the present disclosure.

FIG. 17 illustrates a perspective view (partially exposed) of a ring 300 and tubes 305, 307 for commingling conveyed slurry according to yet another embodiment of a gravel pack assembly to the present disclosure. As before, the ring 300 is disposed on tubing 110 of the wellscreen, and the ring 300 has first and second ring sections 310, 320. These and other features are similar to those discussed above and are reincorporated herein.

In contrast to the previous arrangements, the first and second ring sections 310, 320 each define external channels 313, 323 of the chamber 302, and the ring 300 includes a sleeve 315 disposed at least partially on the first and second ring sections 310, 320 and enclosing the chamber 302 therein. This sleeve 315 can be a separate component from the ring sections 310, 320, although it could be integral to one of them.

As shown, portion of the basepipe 110 may form part of the chamber 302. Of course, one or both of the ring sections 310, 320 can have an interior portion that covers the basepipe 110 so that chamber 302 is enclosed internally as well as being enclosed externally with the sleeve 315. This arrangement of the ring 300 in FIG. 17 can be used on a basepipe between adjacent screens or can be used on any standalone sub located anywhere between wellscreen joints.

In terms of one arrangement, the ring 300 can be a top ring (e.g., 300A in FIGS. 14A-14C) on the wellscreen (50) in which case (a) the first tubes 305 can be tube stubs for connecting to jumper tubes in the blank area of the wellscreen and (b) the second tubes 307 can be transport tubes for extending along the wellscreen. The opposite arrangement is possible, and the ring 300 can be a bottom ring (e.g., 300B in FIGS. 14A-14C) on the wellscreen. Moreover, both the first and second tubes 305, 307 can be transport tubes in which case the ring 300 can be an intermediate ring (e.g., 300C in FIGS. 14A-14C) on the wellscreen. Also, any one or both of the ring sections 310, 302 can have additional tube openings for communicating the chamber 302 with pack tubes (309) in the same manner disclosed elsewhere herein.

Preferably, the ring 300 is arranged to fit concentrically on the wellscreen's tubing, which passes through the ring's throughbore 304. Additionally, the chamber 302 formed from the pockets 313, 323 and internal surface of the sleeve 315 preferably includes an erosion resistant sheath 330, such as disclosed herein.

In each of the rings 300 of FIGS. 15A through 17, the erosion-resistant sheath 330 has erosion-resistant surfaces disposed inside the chamber 302 and exposed to the conveyed slurry communicating between the tube openings (e.g., 306, 308, and 308'). According to the teachings disclosed herein, the erosion-resistant sheath 300 can comprise (a) a coating of erosion resistant material disposed on an inside surface of the chamber 302, (b) a hard surfacing of erosion resistance disposed on an inside surface of the chamber 302, (c) a plurality of plates of erosion-resistant material affixed on an inside surface of the chamber 302, and (d) an insert disposed in the chamber 302 and defining a fluid passage therethrough communicating the tube openings. Such an insert can be composed of an erosion resistant material, can have a coating of erosion resistant material disposed on an inside surface of the fluid passage, or the like. Accordingly, teachings presented above with respect to erosion-resistant sheaths as in FIGS. 3 through 12B can apply equally to the sheath 330 of FIGS. 15A through 17 so that those teachings are reincorporated here.

As can be seen above, the chambered rings 300 of the present disclosure for commingling the slurry for the tubes 305, 307, 309 are not disposed over the blank section of the wellscreen where tubing connections are made. The chambered rings 300 are concentric to the basepipe's axis, although they could be eccentric to the basepipe's axis. The commingle function provides communication of the gravel pack slurry from at least one transport tube to another transport tube (and further to at least one pack tube if used).

Figure 18A:
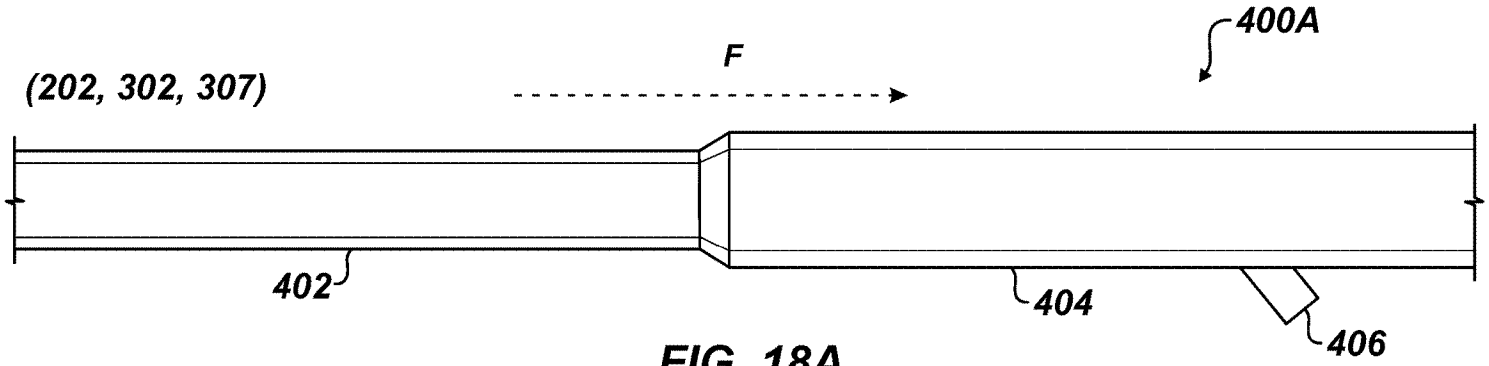
FIGS. 18A-18B illustrate alternative pack tubes for the present disclosure.

In addition to the above, the pack tubes can be designed to further minimize erosion. In particular, the pack tubes (e.g., 204: FIGS. 3, 4A-4B, 5, 7C, 8A-8B, 9A-9C, 10, 11A-11B & 12A-12B and 309: FIGS. 14A-14C & 16A-16C) can include a transition in shape and/or size at any point along its length to reduce the erosion. For example, a pack tube 400A as shown in FIG. 18A transitions from a smaller cross-sectional area disposed toward a proximal end of the pack tube 400A and transitioning to a larger cross-sectional area toward a distal end of the pack tube. In this instance, the pack tube 400A transitions from a smaller rectangular size 402 to a larger rectangular size 404 at a point along its length so the pressure drop from the transport tube 202, 307 or chamber 302 to the pack tube 400A is decreased and the abrasive fluid velocity can be correspondingly less as the flow F travels to the nozzles 406.

Figure 18B:
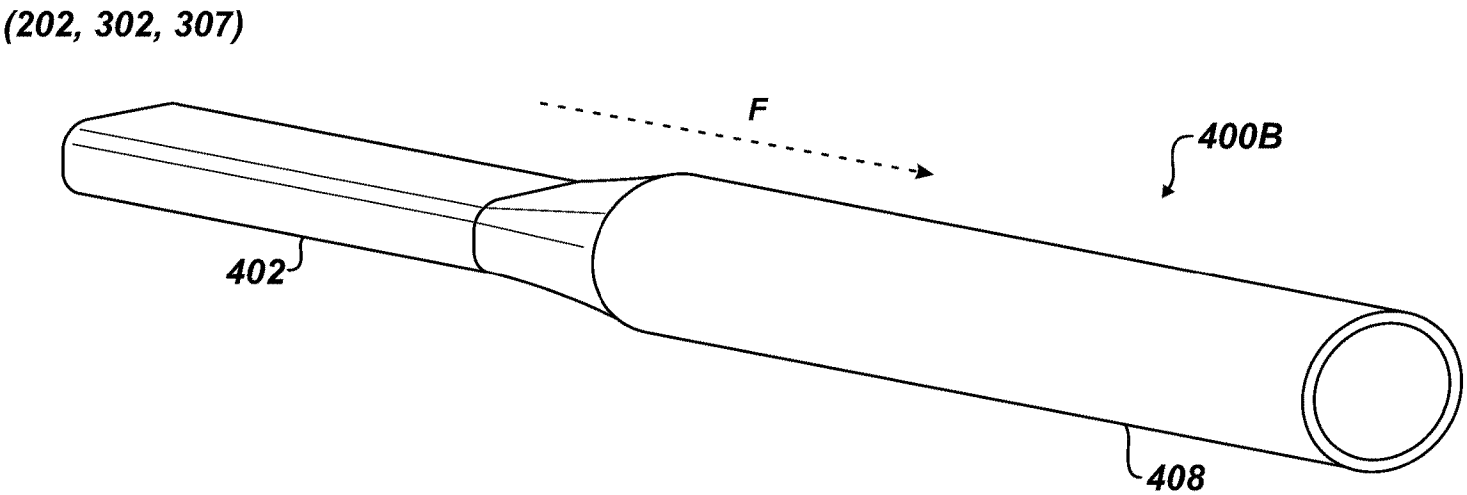

In another example, a pack tube 400B as shown in FIG. 18B transitions from a first cross-sectional shape disposed toward the proximal end and transitioning to a second cross-sectional shape, different from the first cross-sectional shape, toward the distal end of the pack tube 400B. In this instance, the pack tube 400B transitions from a rectangular shape 402 to a round shape 408 at a point along its length so the pressure drop from the transport tube 202, 307 or chamber 302 to the pack tube 400A is decreased and the abrasive fluid velocity can be correspondingly less as the flow F travels to the nozzles (not shown). The change in shape may or may not involve an increase in cross-sectional area.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter. Although not explicitly depicted, for example, the teachings for the erosion resistant sheaths incorporated into the end ring and tubes in FIGS. 3 through 12B above can be used for the erosion resistant sheaths 330 in the chamber 302 incorporated into the ring 300 of FIGS. 13A through 17. For example, any of the sheaths, coating, cladding, inserts, and the like 230A-C can be adapted and used for the chamber 302 incorporated into the ring 300 of FIGS. 13A through 17.

Although not explicitly depicted, for example, the configurations in FIGS. 3 through 9C having the erosion resistant bypass 220 incorporated into the top end ring 210 can be used on a wellscreen 50 in conjunction with the configurations in FIGS. 10 through 12B having the erosion resistant bypass 250 incorporated into the transport tube 202 on the same wellscreen. For example, one side of the wellscreen 50 may include the bypass 220 for the transport and pack tubes 202, 204 incorporated in the top ring 210 while the other side of the wellscreen 50 may include the bypass 250 incorporated into the transport tube 202.

Although not explicitly depicted, for example, the configurations in FIGS. 13A through 17 having the erosion resistant chamber 302 incorporated into the ring 300 can be used on a wellscreen 50 in conjunction with the configurations in FIGS. 10 through 12B having erosion resistant bypasses 250 incorporated into the transport tube on the same wellscreen.

Finally, the commingling of slurry and erosion-resistance benefits disclosed herein have been described with particular reference to various rings used on a wellscreen joint. This is not strictly necessary. The disclosed rings can be used on any standalone sub located anywhere between wellscreen joints.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack assembly for delivering slurry along tubing of a wellscreen, the assembly comprising:

a ring disposed on the tubing of the wellscreen and having first and second ring sections, the first ring section disposed at least partially on the second ring section, the first and second ring sections disposed together defining a chamber therein, a portion of the second ring section defining a channel for the chamber, the first ring section comprising a sleeve positioning over the portion of the second ring section and enclosing the channel to form the chamber, the chamber having first tube openings on a first side of the first ring section, the chamber having second tube openings on a second side of the second ring section;

first tubes for conveying the slurry, each of the first tubes having a first end positioning in fluid communication with one of the first tube openings on the first side of the first ring section and positioning along the tubing of the wellscreen; and second tubes for conveying the slurry, each of the second tubes having a second end positioning in fluid communication with one of the second tube openings on the second side of the second ring section and positioning along the tubing of the wellscreen.

2. The assembly of claim 1, wherein the ring is disposed concentrically on the tubing.

3. The assembly of claim 1, wherein the chamber has at least one third tube opening on the second side of the second ring portion, the assembly further comprising at least one third tube having a third end positioning in fluid communication with the at least one third tube opening on the second side of the second ring section and positioning along the tubing of the wellscreen.

4. The assembly of claim 3, wherein the at least one third tube comprises a pack tube delivering the slurry outside the pack tube and adjacent the wellscreen.

5. The assembly of claim 4, wherein the pack tube comprises at least one of:

a smaller cross-sectional area disposed toward the third end and transitioning to a larger cross-sectional area toward a distal end of the pack tube; and a first cross-sectional shape disposed toward the third end and transitioning to a second cross-sectional shape, different from the first cross-sectional shape, toward the distal end of the pack tube.

6. The assembly of claim 1, wherein the first and second end ring sections each comprises segments positioning about the tubing.

7. The assembly of claim 1, further comprising an erosion-resistant sheath having erosion-resistant surfaces disposed inside the chamber and exposed to the conveyed slurry communicating between the first and second tube openings.

8. The assembly of claim 7, wherein the erosion-resistant sheath comprises one of:

a coating of erosion resistant material disposed on an inside surface of the chamber;

a hard surfacing of erosion resistance disposed on the inside surface of the chamber;

a plurality of plates of erosion-resistant material affixed on the inside surface of the chamber;

an insert disposed in the chamber and composed of an erosion resistant material, the insert defining a fluid passage therethrough communicating the first tube openings with the second tube openings; and an insert disposed in the chamber, the insert defining a fluid passage therethrough communicating the first tube openings with the second tube openings, the insert comprising a coating of erosion resistant material disposed on an inside surface of the fluid passage.

9. The assembly of claim 1, further comprising at least one filter disposed on the tubing of the wellscreen, wherein the ring is disposed on the tubing adjacent a first end of the at least one filter.

10. The assembly of claim 9, further comprising at least one shroud disposed on the tubing of the wellscreen about the at least one filter, wherein the ring supports a second end of the at least one shroud.

11. The assembly of claim 9, wherein the at least one filter comprises first and second filters disposed on the tubing of the wellscreen, wherein the ring is an intermediate ring disposed on the tubing between ends of the first and second filters.

12. The assembly of claim 11, further comprising first and second shrouds disposed on the tubing of the wellscreen respectively about the first and second filters, wherein the ring supports opposing ends of the first and second shrouds.

13. The assembly of claim 9, further comprising jumper tubes connected to the first tubes and extending beyond a joint of the tubing of the wellscreen.

14. The assembly of claim 13, wherein the second tubes comprise transport tubes for communicating the slurry with another wellscreen.

15. A gravel pack assembly for delivering slurry along tubing of a wellscreen, the assembly comprising:

a ring disposed on the tubing of the wellscreen and having first and second ring sections, the first ring section disposed adjacent the second ring section, the first and second ring sections disposed together defining a chamber therein, the chamber having first tube openings on a first side of the first ring section, the chamber having second tube openings on a second side of the second ring section;

first tubes for conveying the slurry, each of the first tubes having a first end positioning in fluid communication with one of the first tube openings on the first side of the first ring section and positioning along the tubing of the wellscreen; and second tubes for conveying the slurry, each of the second tubes having a second end positioning in fluid communication with one of the second tube openings on the second side of the second ring section and positioning along the tubing of the wellscreen, wherein the first and second ring sections each define a channel forming portion of the chamber; and wherein the ring comprises a sleeve disposed at least partially on the first and second ring sections and enclosing the channels to form the chamber therein.

16. The assembly of claim 15, wherein the chamber has at least one third tube opening on the second side of the second ring portion, the assembly further comprising at least one third tube having a third end positioning in fluid communication with the at least one third tube opening on the second side of the second ring section and positioning along the tubing of the wellscreen.

17. The assembly of claim 16, wherein the at least one third tube comprises a pack tube delivering the slurry outside the pack tube and adjacent the wellscreen, wherein the pack tube comprises at least one of:

a smaller cross-sectional area disposed toward the third end and transitioning to a larger cross-sectional area toward a distal end of the pack tube; and a first cross-sectional shape disposed toward the third end and transitioning to a second cross-sectional shape, different from the first cross-sectional shape, toward the distal end of the pack tube.

18. The assembly of claim 15, wherein the first and second end ring sections each comprises segments positioning about the tubing.

19. The assembly of claim 15, further comprising an erosion-resistant sheath having erosion-resistant surfaces disposed inside the chamber and exposed to the conveyed slurry communicating between the first and second tube openings.

20. The assembly of claim 19, wherein the erosion-resistant sheath comprises one of:

a coating of erosion resistant material disposed on an inside surface of the chamber;

a hard surfacing of erosion resistance disposed on the inside surface of the chamber;

a plurality of plates of erosion-resistant material affixed on the inside surface of the chamber;

an insert disposed in the chamber and composed of an erosion resistant material, the insert defining a fluid passage therethrough communicating the first tube openings with the second tube openings; and an insert disposed in the chamber, the insert defining a fluid passage therethrough communicating the first tube openings with the second tube openings, the insert comprising a coating of erosion resistant material disposed on an inside surface of the fluid passage.

21. The assembly of claim 15, further comprising at least one filter disposed on the tubing of the wellscreen, wherein the ring is disposed on the tubing adjacent a first end of the at least one filter.

22. The assembly of claim 21, further comprising at least one shroud disposed on the tubing of the wellscreen about the at least one filter, wherein the ring supports a second end of the at least one shroud.

23. The assembly of claim 21, wherein the at least one filter comprises first and second filters disposed on the tubing of the wellscreen, wherein the ring is an intermediate ring disposed on the tubing between ends of the first and second filters.

24. The assembly of claim 23, further comprising first and second shrouds disposed on the tubing of the wellscreen respectively about the first and second filters, wherein the ring supports opposing ends of the first and second shrouds.

25. The assembly of claim 21, further comprising jumper tubes connected to the first tubes and extending beyond a joint of the tubing of the wellscreen; and wherein the second tubes comprise transport tubes for communicating the slurry with another wellscreen.

26. A gravel pack assembly for delivering slurry along tubing of a wellscreen, the assembly comprising:

a ring disposed on the tubing of the wellscreen and having first and second ring sections, the first ring section disposed at least partially on the second ring section, the first and second ring sections disposed together defining a chamber therein, the chamber having first tube openings on a first side of the first ring section, the chamber having second tube openings on a second side of the second ring section, the chamber having at least one third tube opening on the second side of the second ring portion;

first tubes for conveying the slurry, each of the first tubes having a first end positioning in fluid communication with one of the first tube openings on the first side of the first ring section and positioning along the tubing of the wellscreen;

second tubes for conveying the slurry, each of the second tubes having a second end positioning in fluid communication with one of the second tube openings on the second side of the second ring section and positioning along the tubing of the wellscreen;

at least one third tube having a third end positioning in fluid communication with the at least one third tube opening on the second side of the second ring section and positioning along the tubing of the wellscreen, the at least one third tube comprising a pack tube delivering the slurry outside the pack tube and adjacent the wellscreen, wherein the pack tube comprises at least one of:

a smaller cross-sectional area disposed toward the third end and transitioning to a larger cross-sectional area toward a distal end of the pack tube; and a first cross-sectional shape disposed toward the third end and transitioning to a second cross-sectional shape, different from the first cross-sectional shape, toward the distal end of the pack tube.

* * * * *